US011085459B2

(12) United States Patent
Ishii et al.

(10) Patent No.: US 11,085,459 B2
(45) Date of Patent: Aug. 10, 2021

(54) CENTRIFUGAL BLOWER

(71) Applicant: DENSO CORPORATION, Kariya (JP)

(72) Inventors: Fumiya Ishii, Kariya (JP); Shuzo Oda, Kariya (JP); Shouichi Imahigashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 56 days.

(21) Appl. No.: 16/437,181

(22) Filed: Jun. 11, 2019

(65) Prior Publication Data

US 2019/0293083 A1 Sep. 26, 2019

Related U.S. Application Data

(63) Continuation of application No. PCT/JP2017/044009, filed on Dec. 7, 2017.

(30) Foreign Application Priority Data

Jan. 23, 2017 (JP) ..... JP2017-009580

(51) Int. Cl.
*F04D 29/28* (2006.01)
*F04D 17/16* (2006.01)
(Continued)

(52) U.S. Cl.
CPC ..... *F04D 29/281* (2013.01); *F04D 17/16* (2013.01); *F04D 29/30* (2013.01);
(Continued)

(58) Field of Classification Search
CPC .... F04D 29/281; F04D 29/0613; F04D 29/30; F04D 29/4246; F04D 29/66; F04D 17/16;
(Continued)

(56) References Cited

U.S. PATENT DOCUMENTS 8,956,118 B2 * 2/2015 Wakai ..... F01D 5/048 416/183
2002/0106277 A1 * 8/2002 Chapman ..... F04D 29/023 415/206
(Continued)

FOREIGN PATENT DOCUMENTS

EP 1887227 A1 * 2/2008 ..... F04D 29/30
WO WO-2017090347 A1 6/2017
(Continued)

*Primary Examiner* — Justin D Seabe
*Assistant Examiner* — Ryan C Clark
(74) *Attorney, Agent, or Firm* — Hamess, Dickey & Pierce, P.L.C.

(57) ABSTRACT

A centrifugal blower includes a centrifugal fan and a case that houses the centrifugal fan. A blade of the centrifugal fan has an intake side edge portion extending from a shroud inward in a radial direction. The intake side edge portion has a negative pressure side inclined portion inclined to a negative pressure surface side of the blade with respect to an axial direction. The negative pressure side inclined portion has an inclination length in the axial direction, and the inclination length is larger in a reverse flow portion of the intake side edge portion close to the shroud than in a radially innermost portion of the intake side edge portion located at an innermost side in the radial direction.

8 Claims, 16 Drawing Sheets

(51) Int. Cl.
*F04D 29/42* (2006.01)
*F04D 29/66* (2006.01)
*F04D 29/30* (2006.01)

(52) U.S. Cl.
CPC ..... *F04D 29/4246* (2013.01); *F04D 29/66* (2013.01); *F05D 2240/306* (2013.01); *F05D 2250/711* (2013.01)

(58) Field of Classification Search
CPC ..... F05D 2240/306; F05D 2240/303; F05D 2250/711
USPC ..... 416/182, 186 R, 241 R, 223 A, 223 B
See application file for complete search history.

(56) References Cited

U.S. PATENT DOCUMENTS

| | | | | |
|---|---|---|---|---|
| 2007/0237643 | A1* | 10/2007 | Cho | F04D 29/281 416/182 |
| 2018/0328376 | A1 | 11/2018 | Ishii et al. | |
| 2019/0093665 | A1 | 3/2019 | Ishii et al. | |

FOREIGN PATENT DOCUMENTS

| | | | |
|---|---|---|---|
| WO | WO-2017145780 | A1 | 8/2017 |
| WO | WO-2018020790 | A1 | 2/2018 |

* cited by examiner

CENTRIFUGAL BLOWER

CROSS REFERENCE TO RELATED APPLICATIONS

The present application is a continuation application of International Patent Application No. PCT/JP2017/044009 filed on Dec. 7, 2017, which designated the United States and claims the benefit of priority from Japanese Patent Application No. 2017-009580 filed on Jan. 23, 2017. The entire disclosures of all of the above applications are incorporated herein by reference.

TECHNICAL FIELD

The present disclosure relates to a centrifugal blower for making an air flow.

BACKGROUND ART

A centrifugal blower has an impeller, which includes a shroud, a main plate, and multiple blades.

SUMMARY

According to an aspect of the present disclosure, a centrifugal blower includes: a centrifugal fan that rotates with a rotation shaft to draw in air in an axial direction of the rotation shaft and to blow out the air outward in a radial direction of the rotation shaft; and a case that houses the centrifugal fan, the case having an intake port to draw in air into the centrifugal fan.

The centrifugal fan includes plural blades arranged around an axis center of the rotation shaft, and an intake side plate shaped in a ring that connects ends of the plurality of blades adjacent to the intake port to each other. The case has an intake side case portion facing the intake side plate with a predetermined gap, the intake side case portion having the intake port. Each of the blades has: a positive pressure surface extending along the axial direction; a negative pressure surface opposite to the positive pressure surface; and an intake side edge portion extending from the intake side plate inward in the radial direction. The intake side edge portion has a negative pressure side inclined portion inclined to the negative pressure surface side with respect to the axial direction.

The negative pressure side inclined portion has an inclination length in the axial direction, and the inclination length is larger in a proximal portion of the intake side edge portion close to the intake side plate than in a radially innermost portion of the intake side edge portion located at an innermost side in the radial direction.

DESCRIPTION OF EMBODIMENTS

Figure 1:
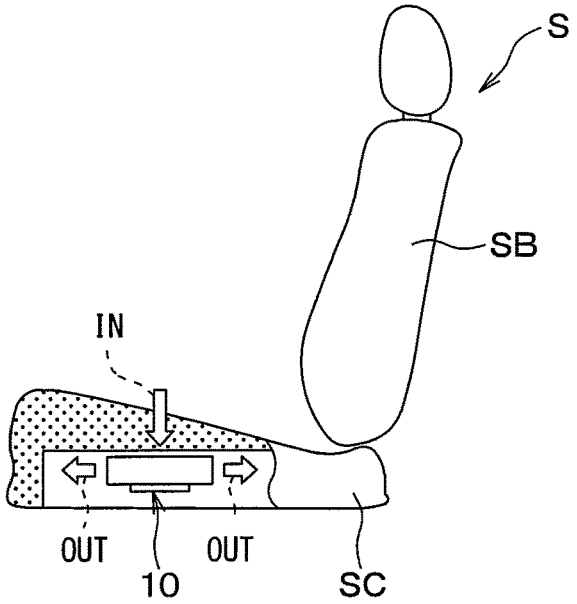
FIG. 1 is a schematic cross-sectional view of a vehicle seat in which a centrifugal blower is mounted according to a first embodiment.

A centrifugal blower having an impeller has been known, which includes a shroud, a main plate, and multiple blades.

To reduce separation of an air flow on a negative pressure surface side of multiple blades, the radius of curvature of the negative pressure surface side at an edge portion of each blade is set to be larger than the radius of curvature of a positive pressure surface side.

The present inventors have studied the adoption of a centrifugal fan having a small size in the axial direction in order to improve the mounting property of the centrifugal blower. In the centrifugal fan of this type, it is difficult to sufficiently secure a passage area for air between the blades.

The present inventors have investigated that the edge portion of each blade is extended inward from the shroud along a radial direction, thereby ensuring the passage area for the air between the blades.

However, if the edge portion of the blade is extended along the radial direction, a reverse flow flows to an intake side of the centrifugal fan through a gap between the shroud and a case, and flows to the shroud side of the edge portion before mixing with the suction air sucked from the intake port of the case. In other words, if the shroud side of the edge portion of the blade is extended along the radial direction, intake air flows inward along the edge portion in the radial direction, and the reverse flow easily flows to the shroud side of the edge portion.

The present inventors have investigated the structure in which an intake air flows inward along the edge portion in the radial direction and the reverse flow flows to the shroud side of the edge portion. In the structure, an air inflow angle is different between the inner side and the outer side of the edge portion, so that the separation of the air flow tends to occur on the negative pressure surface side of the blades. The separation of the air flow on the negative pressure surface side of the blade is not preferable because the separation of the air flow increases the noise.

The present disclosure provides a centrifugal blower capable of reducing the noise caused by the separation of an air flow on a negative pressure surface side of an edge portion of blades.

According to an aspect of the present disclosure, a centrifugal blower includes: a centrifugal fan that rotates with a rotation shaft to draw in air in an axial direction of the rotation shaft and to blow out the air outward in a radial direction of the rotation shaft; and a case that houses the centrifugal fan, the case having an intake port to draw in air into the centrifugal fan.

The centrifugal fan includes plural blades arranged around an axis center of the rotation shaft, and an intake side plate shaped in a ring that connects ends of the plurality of blades adjacent to the intake port to each other. The case has an intake side case portion facing the intake side plate with a predetermined gap, the intake side case portion having the intake port. Each of the blades has: a positive pressure surface extending along the axial direction; a negative pressure surface opposite to the positive pressure surface; and an intake side edge portion extending from the intake side plate inward in the radial direction. The intake side edge portion has a negative pressure side inclined portion inclined to the negative pressure surface side with respect to the axial direction.

The negative pressure side inclined portion has an inclination length in the axial direction, and the inclination length is larger in a proximal portion of the intake side edge portion close to the intake side plate than in a radially innermost portion of the intake side edge portion located at an innermost side in the radial direction.

In this manner, the inclination length of the negative pressure side inclined portion is set larger in the proximal portion closer to the intake side plate than in the radially innermost portion, thereby being capable of reducing a sudden change in a direction of the air flow in the vicinity of the negative pressure side inclined portion. As a result, the reverse flow flowing into the centrifugal fan through the gap between the intake side plate and the intake side case portion easily flows along the negative pressure side inclined portion, thereby reducing the separation of the air flow on the negative pressure surface side. This makes it possible to reduce the noise of the centrifugal blower caused by the separation of the air flow on the negative pressure surface side.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

The present embodiment will be described with reference to FIGS. 1 to 17. In the present embodiment, a centrifugal blower 10 of the present disclosure is applied to a seat air conditioner for a vehicle. The seat air conditioner has a configuration in which an air is drawn from the vicinity of a surface of a seat S through fine holes provided on an occupant side of the seat S, thereby lowering a temperature and a humidity in the vicinity of the surface of the seat S to improve a cooling feeling of the occupant.

As shown in FIG. 1, the centrifugal blower 10 according to the present embodiment is disposed in a seat cushion portion SC of the seat S on which the occupant is seated. The centrifugal blower 10 according to the present embodiment draws in the air from the surface of the seat cushion portion SC on the occupant side. The air blown out from the centrifugal blower 10 is blown out from a portion other than the surface of the seat cushion portion SC on the occupant side. The centrifugal blower 10 may be housed not only in the seat cushion portion SC of the seat S but also in the seat back portion SB of the seat S.

Figure 2:
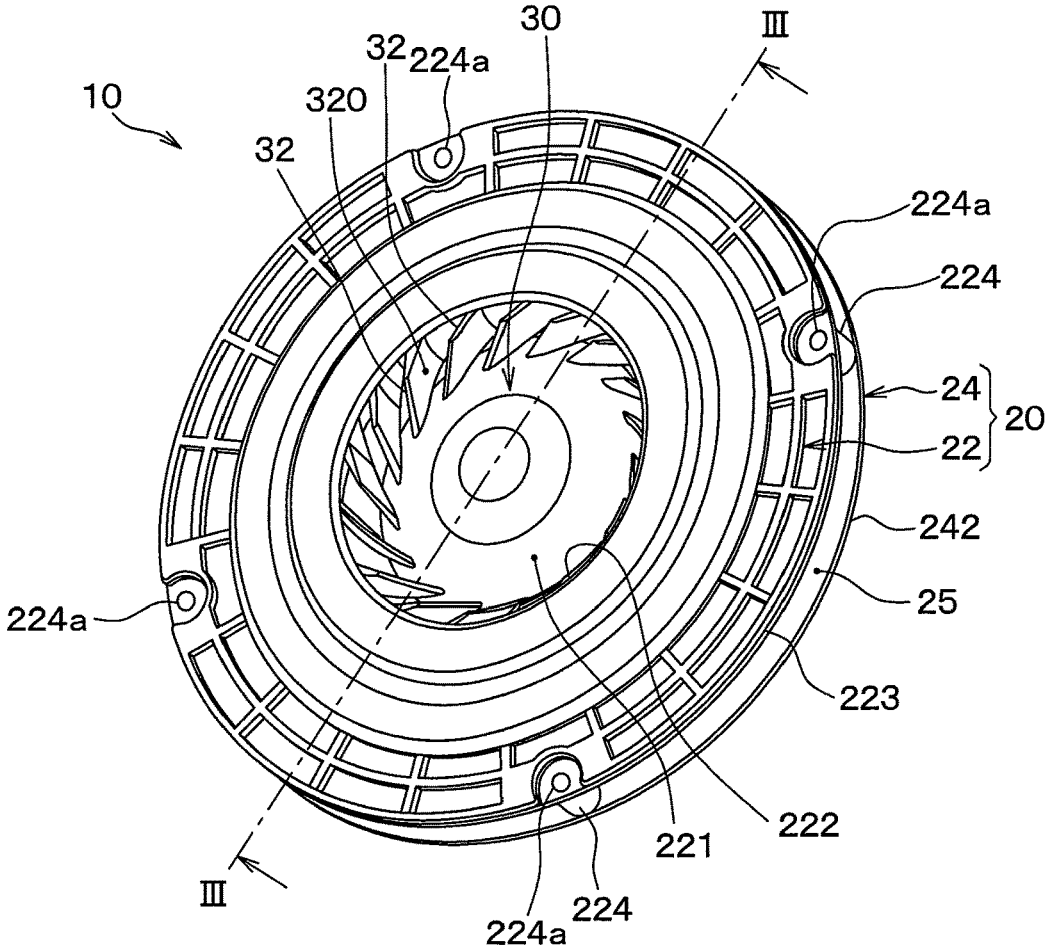
FIG. 2 is a schematic perspective view showing an appearance of the centrifugal blower according to the first embodiment.
Figure 3:
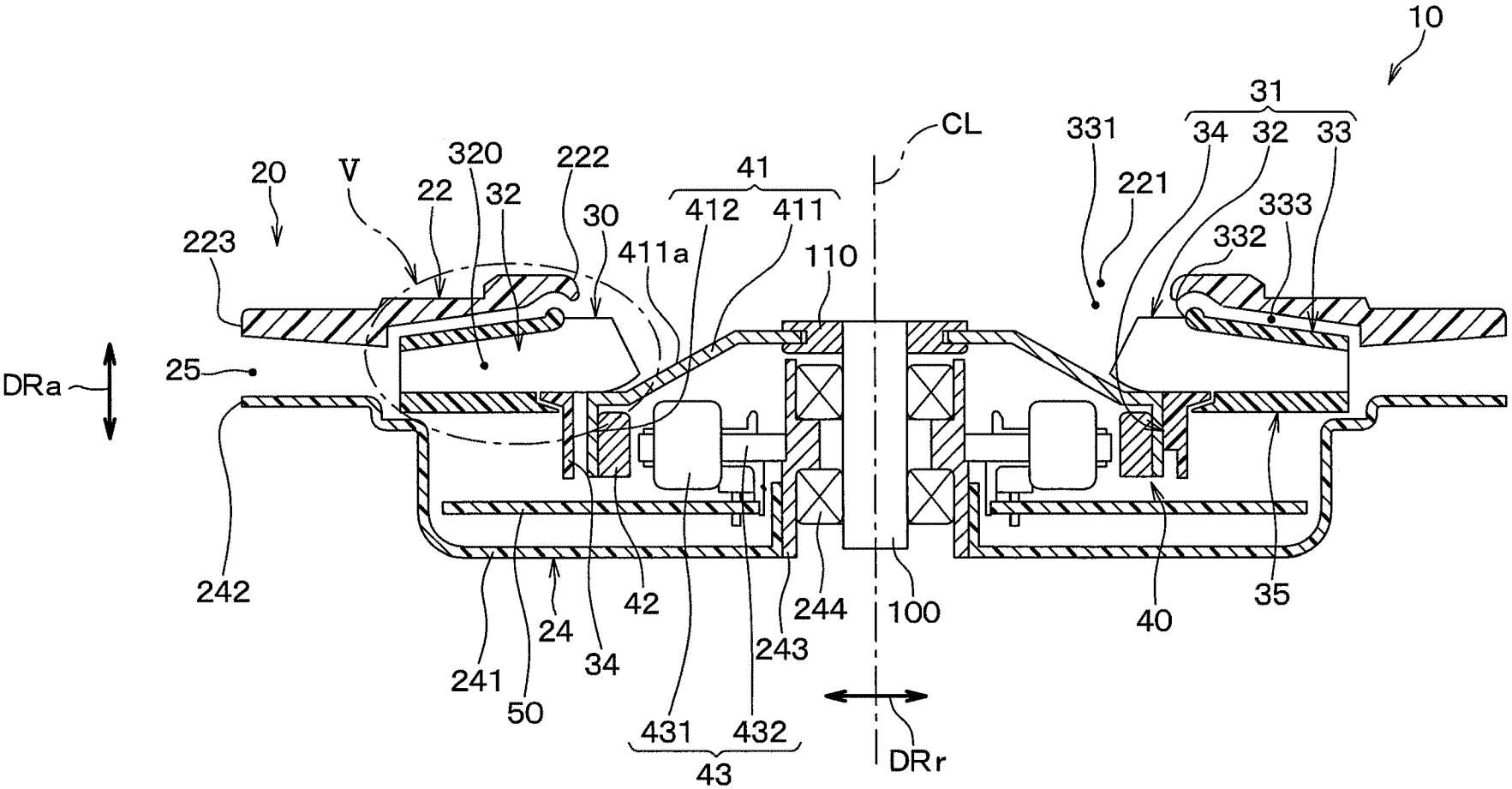
FIG. 3 is a cross-sectional view taken along a line III-III of FIG. 2.

As shown in FIG. 2, the centrifugal blower 10 is configured by a turbo type blower. As shown in FIG. 3, the centrifugal blower 10 includes a case 20, a rotation shaft 100, a centrifugal fan 30, an electric motor 40, and a circuit board 50. An arrow DRa shown in FIG. 3 indicates an axial direction extending along an axis center CL of the rotation shaft 100. An arrow DRr shown in FIG. 3 indicates a radial direction of the rotation shaft 100.

The case 20 is a housing configuring an outer shell of the centrifugal blower 10. The centrifugal fan 30, the electric motor 40, and the circuit board 50 are housed in the case 20. The centrifugal fan 30, the electric motor 40, and the circuit board 50 are housed within the case 20 to protect against dust and dirt outside the centrifugal blower 10. The case 20 according to the present embodiment has an intake side case portion 22 and a motor side case portion 24.

The intake side case portion 22 has a substantially ring shape having an outer diameter larger than that of the centrifugal fan 30. The intake side case portion 22 according to the present embodiment is made of resin. The intake side case portion 22 may be made of metal.

An air intake port 221 is defined in the center of the intake side case portion 22. The intake port 221 is formed of a through hole penetrating through the axial direction DRa. The intake side case portion 22 is disposed to face the shroud 33 configuring the end portion of the centrifugal fan 30 on the intake port 221 side with a predetermined interval in the axial direction DRa.

In the intake side case portion 22, a bell mouth portion 222 that smoothly guides the air flowing from the outside of the centrifugal blower 10 into the intake port 221 to the intake port 221 is formed at a peripheral portion of the intake port 221. In the present embodiment, the bell mouth portion 222 configures an intake port defining portion that defines the intake port 221. Details of the bell mouth portion 222 will be described later.

As shown in FIG. 2, in the intake side case portion 22, multiple strut portions 224 protruding in the axial direction DRa are formed inside the intake side case peripheral portion 223 located on the outermost side in the radial direction DRr. The intake side case portion 22 is coupled to the motor side case portion 24 in a state in which tips of the strut portions 224 abut against the motor side case portion 24. A screw hole 224*a* through which a screw (not shown) for coupling the intake side case portion 22 and the motor side case portion 24 is inserted is defined in each of the strut portions 224.

The motor side case portion 24 has a disc-like shape having an outer diameter substantially equal to that of the intake side case portion 22. The motor side case portion 24 according to the present embodiment is made of resin. The motor side case portion 24 may be made of metal such as iron or stainless steel.

As shown in FIG. 3, the motor side case portion 24 is disposed to face the fan plate 35 which configures an end portion of the centrifugal fan 30 opposite to the intake port 221 at a predetermined interval in the axial direction DRa.

In the motor side case portion 24, a recess portion 241 is provided in which a portion facing the centrifugal fan 30 in the axial direction DRa is recessed in a direction away from the centrifugal fan 30. The recess portion 241 functions as a motor housing for covering the electric motor 40 and the circuit board 50.

The motor side case portion 24 is coupled to the intake side case portion 22 in a state in which the inner side of the motor side case peripheral portion 242 located on the outermost side in the radial direction DRr is abutted against the tips of the strut portions 224 of the intake side case portion 22.

In the case 20 according to the present embodiment, a blowing port 25 for blowing out the air blown out from the centrifugal fan 30 to the outside of the case 20 is defined between the intake side case peripheral portion 223 and the motor side case peripheral portion 242.

A cylindrical bearing housing 243 projecting toward the centrifugal fan 30 is fixed to a central portion of the recess portion 241 of the motor side case portion 24. The bearing housing 243 is made of a metal such as aluminum alloy, brass, iron, or stainless steel.

A bearing 244 for rotatably supporting the rotation shaft 100 is disposed inside the bearing housing 243. The rotation shaft 100 is disposed inside the bearing 244. Specifically, an outer ring of the bearing 244 is fixed to the bearing housing 243 by press-fitting or the like, and an inner ring of the bearing 244 is fixed to the rotation shaft 100 by press-fitting or the like.

The rotation shaft 100 is a cylindrical shaft that transmits a rotational driving force output from the electric motor 40 to the centrifugal fan 30. The rotation shaft 100 is rotatably supported by the bearing housing 243 through the bearing 244.

A rotation shaft housing 110 for connecting the rotation shaft 100 and the centrifugal fan 30 is fixed to an end portion of the rotation shaft 100 on the centrifugal fan 30 side by press-fitting or the like. The rotation shaft 100 and the rotation shaft housing 110 are made of metal such as iron, stainless steel, brass, or the like.

Subsequently, the electric motor 40 is an electric motor that rotationally drives the centrifugal fan 30 through the rotation shaft 100. The electric motor 40 according to the present embodiment is formed of an outer rotor type brushless DC motor.

The electric motor 40 is disposed between the centrifugal fan 30 and the motor side case portion 24 of the case 20. The electric motor 40 includes a rotor 41, a rotor magnet 42, and a motor stator 43.

The rotor 41 is formed of a plate made of metal such as a steel plate. The rotor 41 according to the present embodiment has a rotor body 411 and a rotor outer peripheral portion 412. The rotor body 411 has a disc shape having an opening at the center. The rotor body 411 has a substantially conical shape so as to come closer to the intake port 221 from the outside to the inside in the radial direction DRr. The rotation shaft housing 110 is fixed to the opening of the rotor body 411 by caulking or the like so that the rotor body 411 and the rotation shaft housing 110 can rotate integrally with each other. The surface of the rotor body 411 on the intake port 221 side configures an air flow guide surface 411*a* for guiding the air flow drawn from the intake port 221 toward the outside in the radial direction DRr.

The rotor outer peripheral portion 412 is located at an outer peripheral end portion of the rotor body 411 in the radial direction DRr. The rotor outer peripheral portion 412 extends in a cylindrical shape from the outer peripheral end portion of the rotor body 411 to a side opposite to the intake port 221 in the axial direction DRa. The rotor outer peripheral portion 412 is press-fitted into an inner peripheral side of a rotor storage portion 34 of the centrifugal fan 30, which will be described later. As a result, the rotor 41 and the centrifugal fan 30 are fixed.

The centrifugal fan 30 and the rotor 41 are fixed to the rotation shaft 100 through the rotation shaft housing 110. For that reason, the centrifugal fan 30 and the rotor 41 are rotatably supported around the axis center CL of the rotation shaft 100 with respect to the case 20 as a non-rotating member of the centrifugal blower 10.

The rotor magnet 42 is made of a permanent magnet. The rotor magnet 42 is made of, for example, a rubber magnet containing ferrite, neodymium, or the like. The rotor magnet 42 is fixed to an inner peripheral surface of the rotor outer peripheral portion 412. Therefore, the rotor 41 and the rotor magnet 42 rotate integrally with the centrifugal fan 30 about the axis center CL of the rotation shaft 100.

The motor stator 43 includes a stator coil 431 and a stator core 432 which are electrically connected to the circuit board 50. The motor stator 43 is disposed inside the rotor magnet 42 in the radial direction DRr with a small gap between the motor stator 43 and the rotor magnet 42. The motor stator 43 is fixed to the motor side case portion 24 through the bearing housing 243.

In this example, the circuit board 50 is a board on which electronic components (not shown) for driving the electric motor 40 are mounted. The circuit board 50 is connected to the motor stator 43 through a connection terminal (not shown).

Subsequently, the centrifugal fan 30 is an impeller that blows the air drawn from the axial direction DRa of the rotation shaft 100 toward the outside in the radial direction DRr. The centrifugal fan 30 has a fan body 31 and a fan plate 35.

The fan body 31 includes multiple blades 32, a shroud 33, and a rotor storage portion 34. The fan body 31 is made of resin. The fan body 31 is formed by one injection molding. In other words, the multiple blades 32, the shroud 33, and the rotor storage portion 34 are formed as an integrally molded product. Accordingly, the multiple blades 32, the shroud 33, and the rotor storage portion 34 are continuous with each other, and are all made of the same material.

The multiple blades 32 are arranged radially around the axis center CL of the rotation shaft 100. Specifically, the multiple blades 32 are arranged side by side in a circumferential direction of the rotation shaft 100 so that the air flows between the adjacent blades 32. In the multiple blades 32, an inter-blade flow channel 320 through which the air flows is provided between the blades 32 adjacent to each other.

The shroud 33 has a disc shape extending in the radial direction DRr. An intake hole 331 into which the air is drawn from the intake port 221 of the case 20 is defined on the inner peripheral side of the shroud 33. The intake hole 331 is formed by an inner peripheral side end portion 332 of the shroud 33. The inner peripheral side end portion 332 is an end provided inside the shroud 33 in the radial direction DRr.

The shroud 33 is connected to the end portion of each blade 32 adjacent to the intake port 221. In other words, the end portions of the respective blades 32 on the intake port 221 side are connected to each other by the shroud 33.

The centrifugal fan 30 is disposed so that a predetermined gap flow channel 333 is provided between the shroud 33 and the intake side case portion 22 so that the shroud 33 and the intake side case portion 22 do not come in contact with each other. According to the present embodiment, the shroud 33 configures an intake side plate that connects the end portions of the multiple blades 32 on the intake port 221 side.

The rotor storage portion 34 has a cylindrical shape centered on the axis center CL of the rotation shaft 100. The rotor storage portion 34 is connected to an end portion of each blade 32 opposite to the intake port 221. The rotor 41 is disposed on the inner peripheral side of the rotor storage portion 34.

Figure 4:
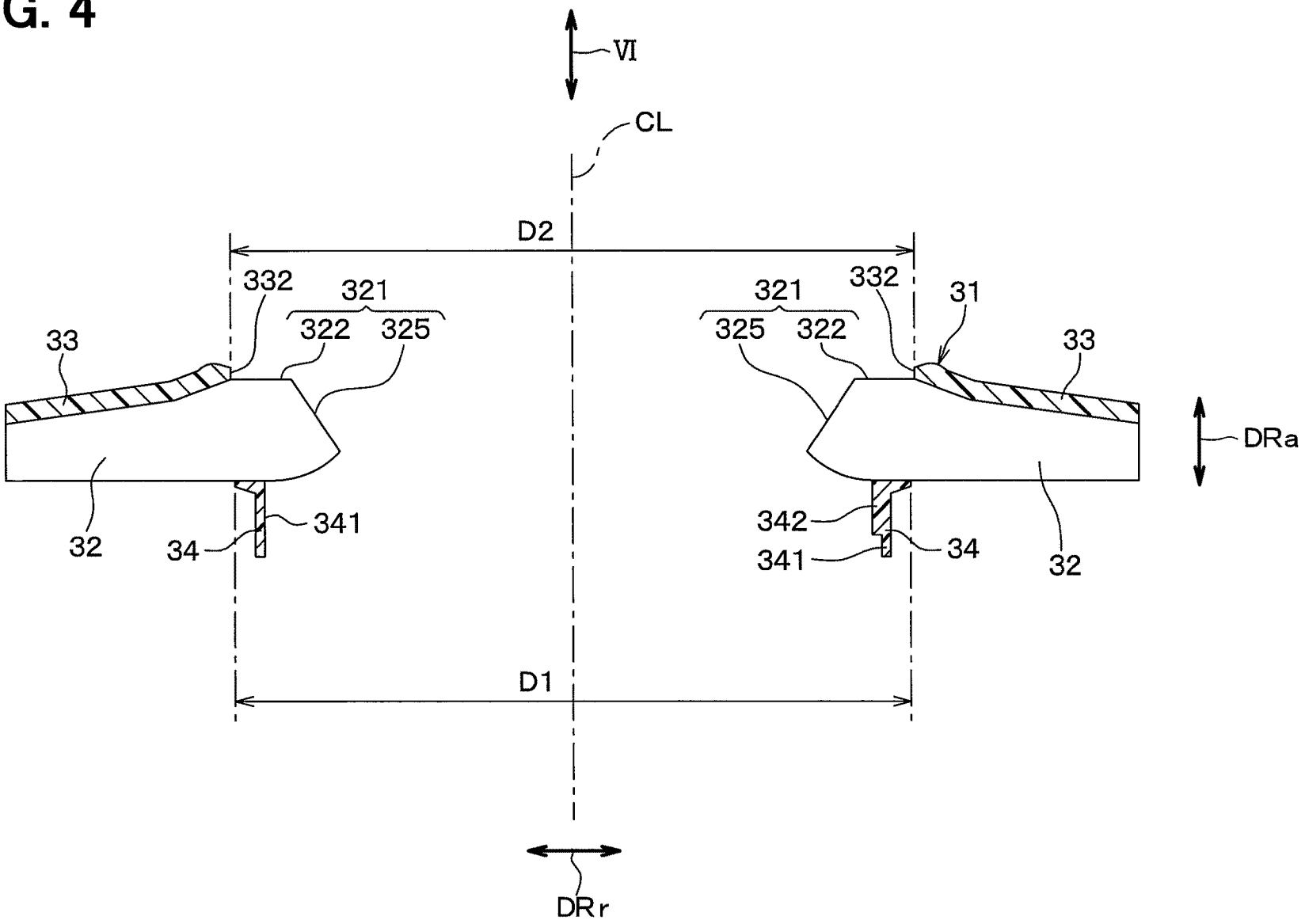
FIG. 4 is a schematic cross-sectional view of a fan body of the centrifugal blower according to the first embodiment.

As shown in FIG. 4, the rotor storage portion 34 includes a main body 341 and multiple ribs 342. The main body 341 is formed in a cylindrical shape. The multiple ribs 342 are multiple protrusion portions protruding from the inner peripheral side of the main body 341. Each of the multiple ribs 342 is aligned in a circumferential direction of the main body 341 with a predetermined gap between the adjacent ribs 342. The multiple ribs 342 are provided between the adjacent blades 32. A rotor outer peripheral portion 412 is press-fitted inside the multiple ribs 342. As a result, the rotor outer peripheral portion 412 is fixed to the inner peripheral side of the rotor storage portion 34.

In this example, an outermost diameter D1 of the rotor storage portion 34 is smaller than a minimum inner diameter D2 of the shroud 33 (that is, D1<D2) so that the rotor storage portion 34 does not overlap with the shroud 33 in the axial direction DRa. This allows the fan body 31 to be stamped in a direction along the axial direction DRa during manufacturing.

Returning to FIG. 3, the fan plate 35 has a shape that expands in a disc shape in the radial direction DRr. The fan plate 35 has a toric shape by provision of a through hole on the inner peripheral side of the fan plate 35. The fan plate 35 is formed of a resin molded article molded separately from the fan body 31.

The fan plate 35 is joined to an end portion of the multiple blades 32 opposite to the intake port 221. The fan plate 35 and the blades 32 are joined to each other by, for example, vibration welding or heat welding. Therefore, in view of the joining property by welding of the fan plate 35 and the blades 32, the fan plate 35 and the fan body 31 are preferably made of a thermoplastic resin, and more preferably made of the same material.

The centrifugal fan 30 according to the present embodiment is configured as a so-called closed fan in which both sides of the inter-blade flow channels 320 of the multiple blades 32 in the axial direction DRa are covered with the shroud 33 and the fan plate 35.

Figure 5:
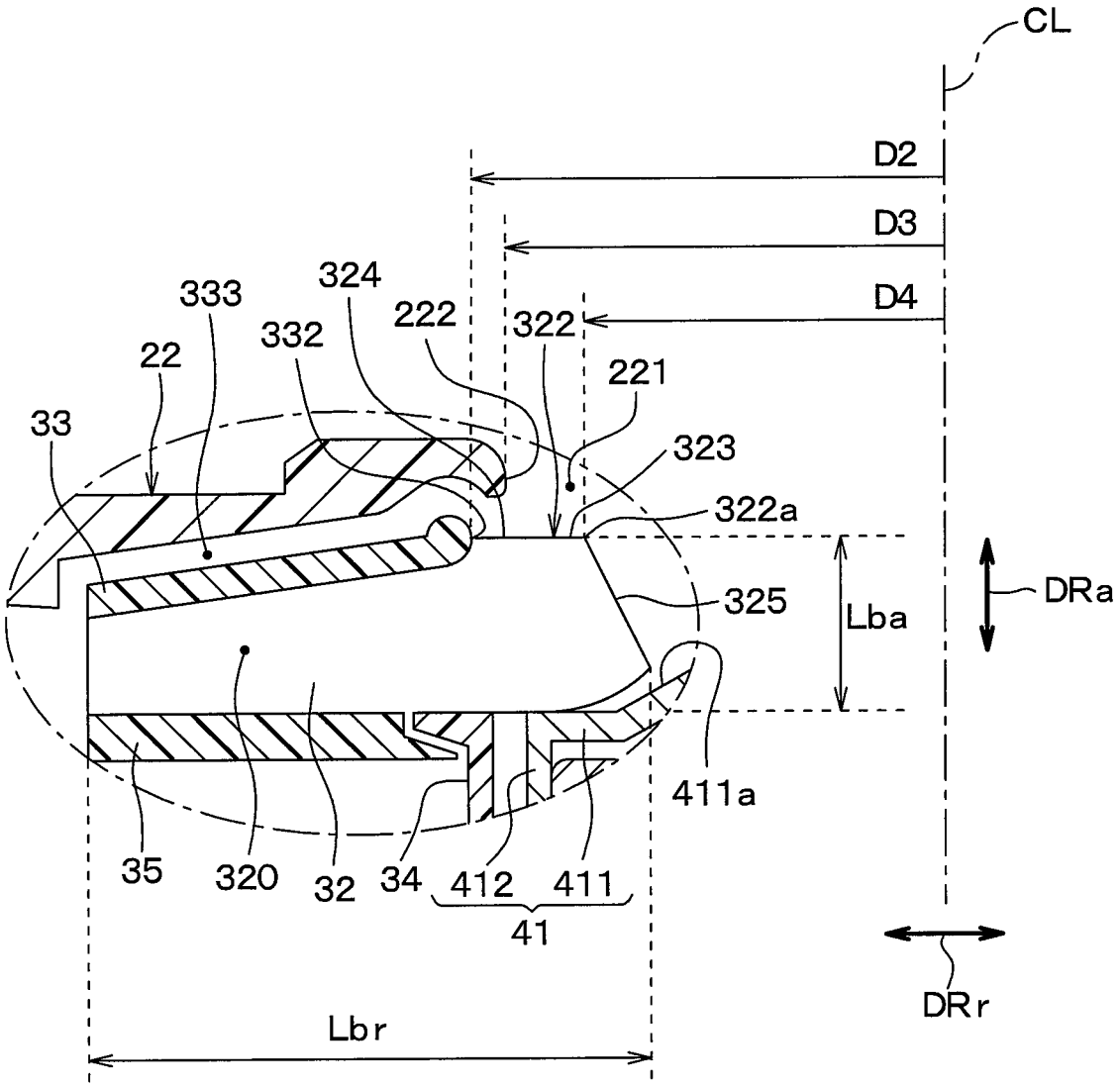
FIG. 5 is an enlarged view of a portion V of FIG. 3.

In this example, as shown in FIG. 5, the bell mouth portion 222 of the intake side case portion 22 is configured to overlap with the edge portions 321 of the multiple blades 32 in the axial direction DRa so that the air from the intake port 221 can easily flow into the edge portions 321 of the multiple blades 32. More specifically, in the bell mouth portion 222, an opening diameter D3 of the intake port 221 is smaller than the minimum inner diameter D2 of the shroud 33 (that is, D3<D2).

In addition, the multiple blades 32 are formed of wings in which a dimension Lba in the axial direction DRa is smaller than a dimension Lbr in the radial direction DRr (that is, Lba<Lbr). As a result, the centrifugal fan 30 has a small body size in the axial direction DRa.

However, in a configuration in which blades having a small dimension Lba in the axial direction DRa are employed as the multiple blades 32, it is difficult to sufficiently secure passage areas for the air between the blades 32. The small passage area of the air between the blades 32 is not preferable because an effective area for blowing the air becomes small which causes a decrease in the blowing rate, and so on.

Therefore, the edge portions 321 of the multiple blades 32 protrude inward from the shroud 33 in the radial direction DRr. Specifically, the edge portions 321 of the multiple blades 32 each have an intake side edge portion 322 extending along the radial direction DRr, and an inclined edge portion 325 extending from the radially innermost portion 322*a* of the intake side edge portion 322 toward the rotor body 411.

An inner diameter D4 of the radially innermost portion 322*a* of the intake side edge portion 322 is smaller than the opening diameter D3 of the intake port 221 so that the air flows in from the intake port 221 (that is, D4<D3). The intake side edge portion 322 has a main flow portion 323 into which the air flows from the intake port 221, and a reverse flow portion 324 into which a reverse flow from the gap flow channel 333 between the shroud 33 and the intake side case portion 22 flows.

The main flow portion 323 is an inner portion including the radially innermost portion 322*a* located on the innermost side in the radial direction DRr. Specifically, the main flow portion 323 is a non-overlapping portion that does not overlap with the intake side case portion 22 in the axial direction DRa. Since the main flow portion 323 does not overlap with the intake side case portion 22, the air from the intake port 221 easily flows in.

On the other hand, the reverse flow portion 324 is an outer portion located adjacent to the shroud 33 compared to the main flow portion 323. Specifically, the reverse flow portion 324 is an overlapping portion that overlaps with the intake side case portion 22 in the axial direction DRa. Since the reverse flow portion 324 overlaps with the intake side case portion 22, the reverse flow from the gap flow channel 333 between the shroud 33 and the intake side case portion 22 is easier to flow in than the air from the intake port 221. According to the present embodiment, the reverse flow portion 324 configures a proximal portion close to the shroud 33 at the intake side edge portion 322.

The inclined edge portion 325 extends from the radially innermost portion 322*a* of the intake side edge portion 322 to a position close to the air flow guide surface 411*a* of the rotor body 411. The inclined edge portion 325 is inclined such that the inner diameter gradually decreases from the intake port 221 side in the axial direction DRa toward the opposite side of the intake port 221.

Figure 6:
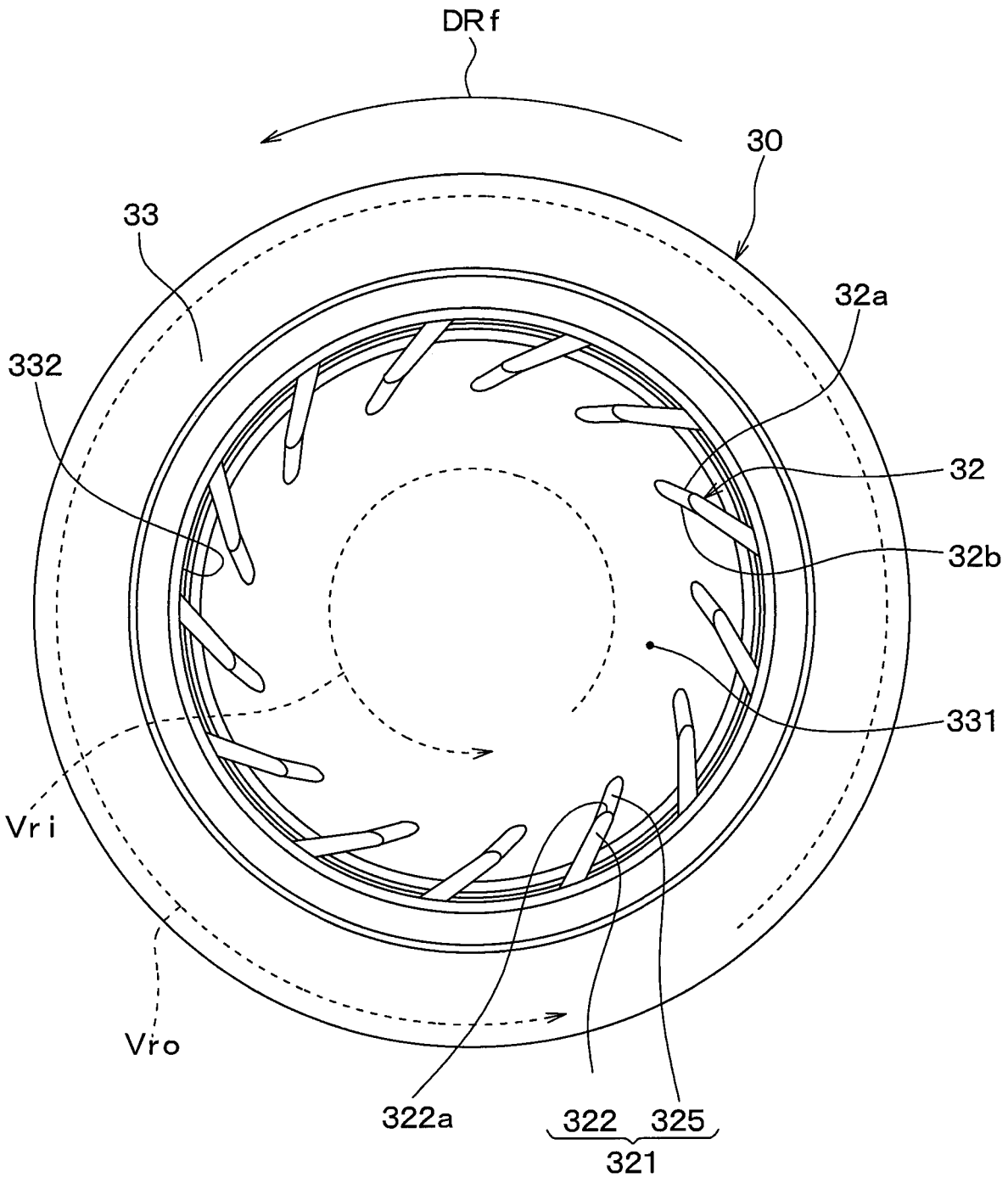
FIG. 6 is a schematic view of the fan body when viewed in a direction indicated by an arrow VI in FIG. 4.

As shown in FIG. 6, each of the multiple blades 32 has a positive pressure surface 32*a* and a negative pressure surface 32*b* forming a blade shape. The positive pressure surface 32*a* is a blade surface located forward of the fan rotation direction DRf of the centrifugal fan 30. The negative pressure surface 32*b* is a blade surface located behind the centrifugal fan 30 in the fan rotation direction DRf. Each of the positive pressure surface 32*a* and the negative pressure surface 32*b* has a curved shape so as to expand toward the front side in the fan rotation direction DRf.

In the centrifugal blower 10 configured as described above, when an electric power is supplied to the stator coil 431 of the electric motor 40 through the circuit board 50, a magnetic flux change occurs in the stator core 432. When the magnetic flux change occurs in the stator core 432, a force for attracting the rotor magnet 42 is generated. The rotor 41 is rotated about the rotation shaft 100 by a force attracting the rotor magnet 42.

In the centrifugal fan 30, the rotor 41 is fixed to the fan body 31. For that reason, when the electric power is supplied to the stator coil 431, the centrifugal fan 30 rotates integrally with the rotor 41. At this time, the multiple blades 32 of the centrifugal fan 30 impart a momentum to the air, so that the air is blown out to the outside in the radial direction DRr in the centrifugal fan 30.

Figure 7:
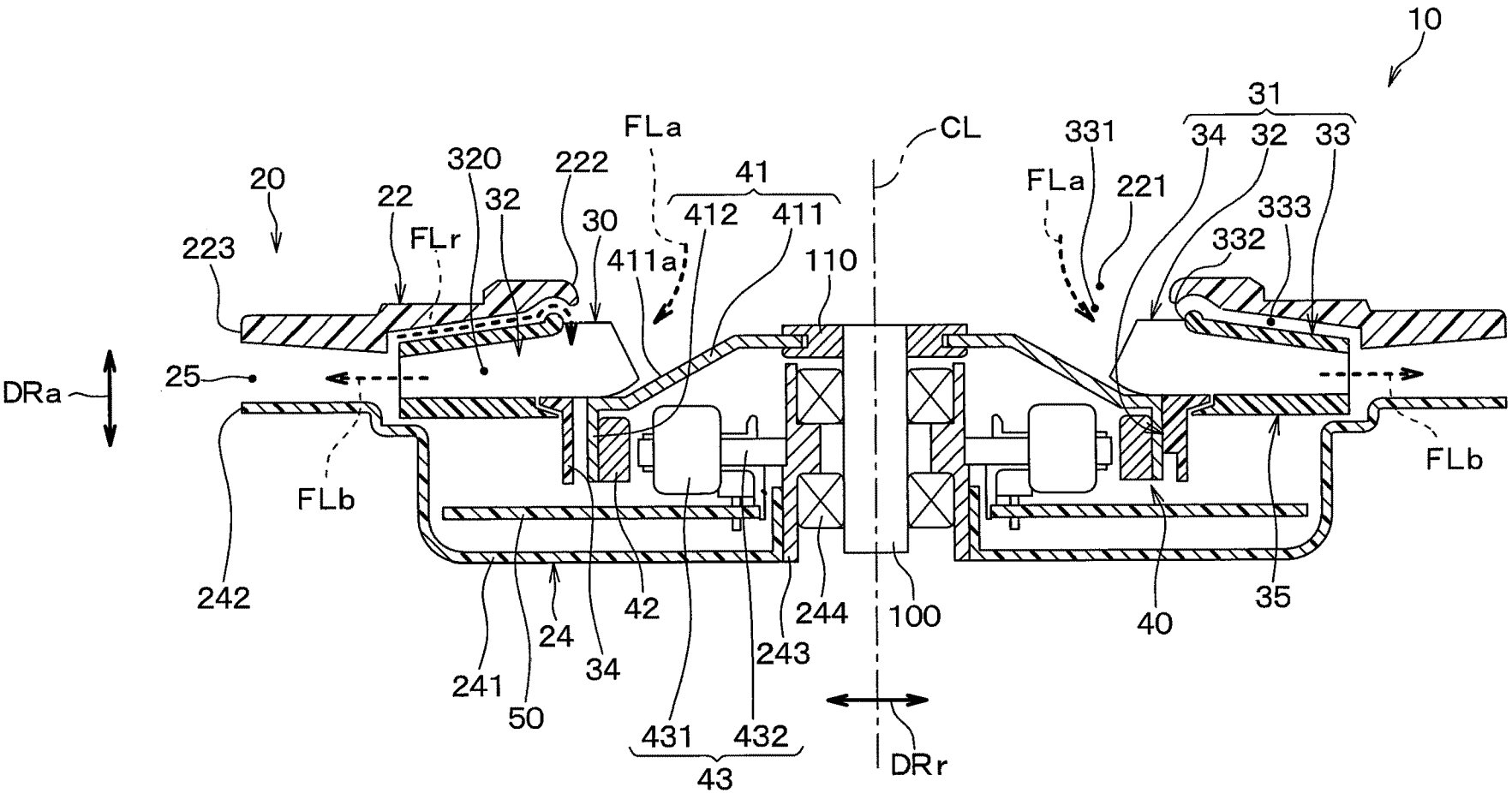
FIG. 7 is a view illustrating a flow direction of air in the centrifugal blower according to the first embodiment.

As a result, in the centrifugal blower 10, the air is drawn along the axial direction DRa from the intake port 221 of the case 20, as indicated by an arrow FLa in FIG. 7. The air drawn from the intake port 221 of the case 20 is blown out to the outside in the radial direction DRr by the centrifugal fan 30, as indicated by an arrow FLb in FIG. 7. The air blown out from the centrifugal fan 30 is blown out to the outside of the case 20 from the blowing port 25 of the case 20.

At this time, in the centrifugal blower 10, a pressure on the air suction side of the centrifugal fan 30 is lower than a pressure on the air blowing side of the centrifugal fan 30. For that reason, in the centrifugal blower 10, as indicated by an arrow FLr in FIG. 7, a part of the air blown out from the centrifugal fan 30 flows back to the intake port 221 side through the gap flow channel 333.

In the centrifugal fan 30 according to the present embodiment, the edge portion 321 of the blade 32 includes an intake side edge portion 322 extending along the radial direction DRr. For that reason, the reverse flow tends to flow into the reverse flow portion 324 of the intake side edge portion 322 before mixing with the air drawn from the intake port 221.

In this example, as shown in FIG. 6, in the centrifugal fan 30, a peripheral speed Vro on the outside in the fan rotation direction DRf becomes higher than a peripheral speed Vri on the inside in the radial direction DRr. For that reason, in the intake side edge portion 322, the air having the low peripheral speed Vri easily flows into the main flow portion 323 from the side of the intake port 221, and the air having the high peripheral speed Vro easily flows into the reverse flow portion 324 from the side of the gap flow channel 333.

Since the reverse flow flowing into the reverse flow portion 324 passes through the gap flow channel 333 having a large ventilation resistance, a velocity Vao of the air in the axial direction DRa tends to be lower than a velocity Vai of the air in the axial direction DRa flowing into the main flow portion 323.

Figure 8:
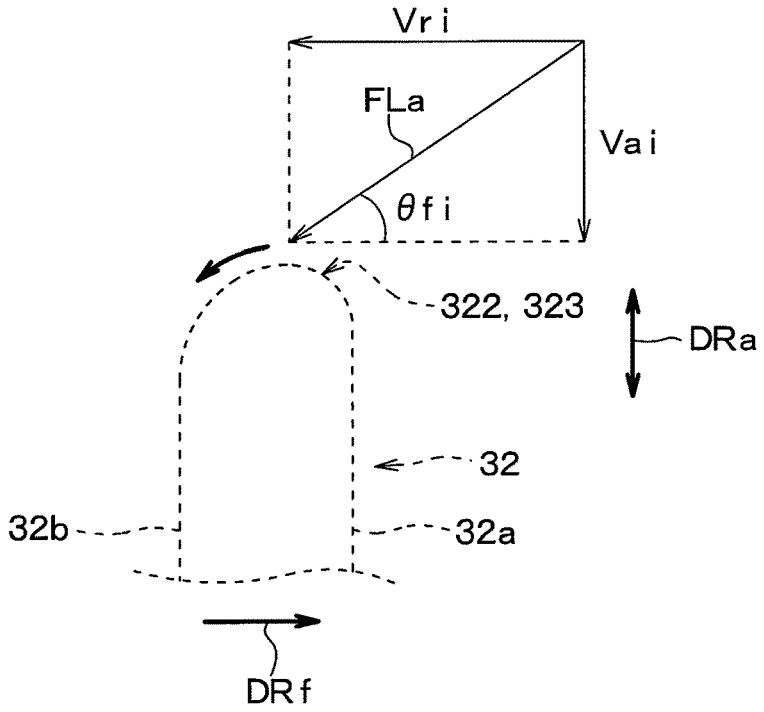
FIG. 8 is a view illustrating an inflow angle of air flowing into a main flow portion of an intake side edge portion.
Figure 9:
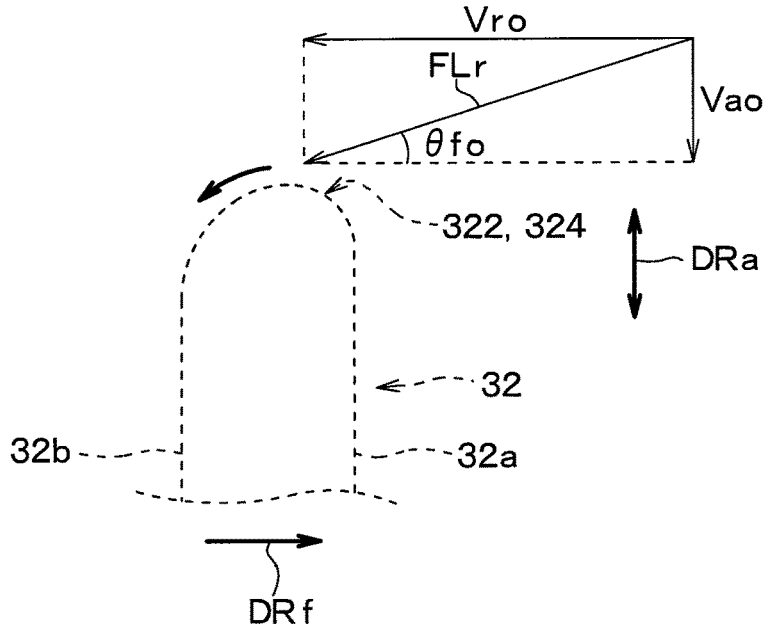
FIG. 9 is a view illustrating an inflow angle of air flowing into a reverse flow portion of the intake side edge portion.

Therefore, as shown in FIG. 8 and FIG. 9, in the intake side edge portion 322, an inflow angle θfo of the reverse flow FLr flowing into the reverse flow portion 324 is likely to be smaller than an inflow angle θfi of the air FLa flowing into the main flow portion 323 (that is, $\theta fo<\theta fi$). An inflow angle θf is an angle formed by a combined vector of a speed vector of the air in the fan rotation direction DRf and a speed vector of the air in the axial direction DRa and the fan rotation direction DRf.

Figure 10:
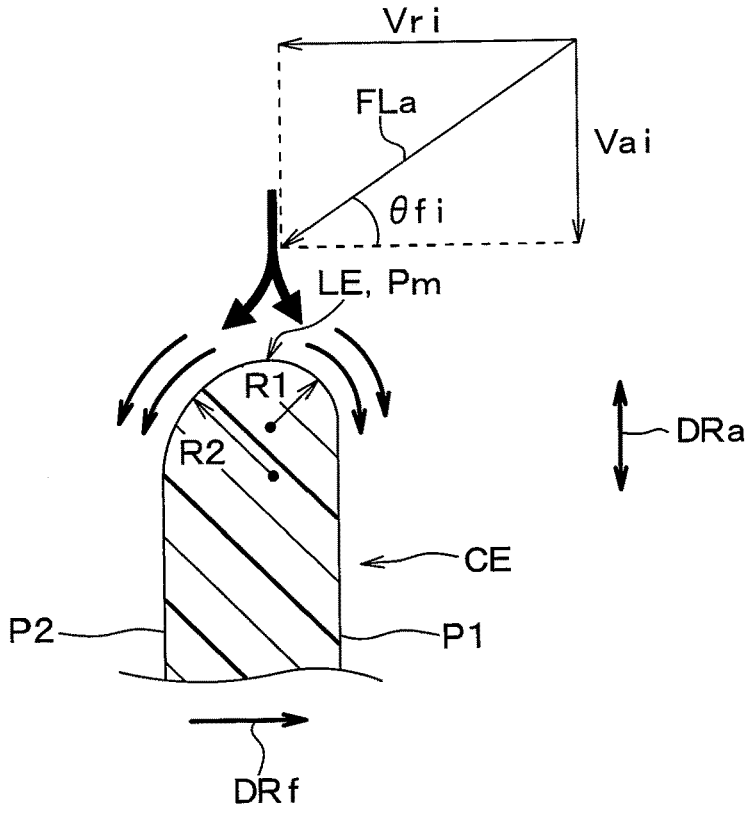
FIG. 10 is a view illustrating a flow of air flowing into a main flow portion of an intake side edge portion of a centrifugal blower as a comparative example of the first embodiment.
Figure 11:
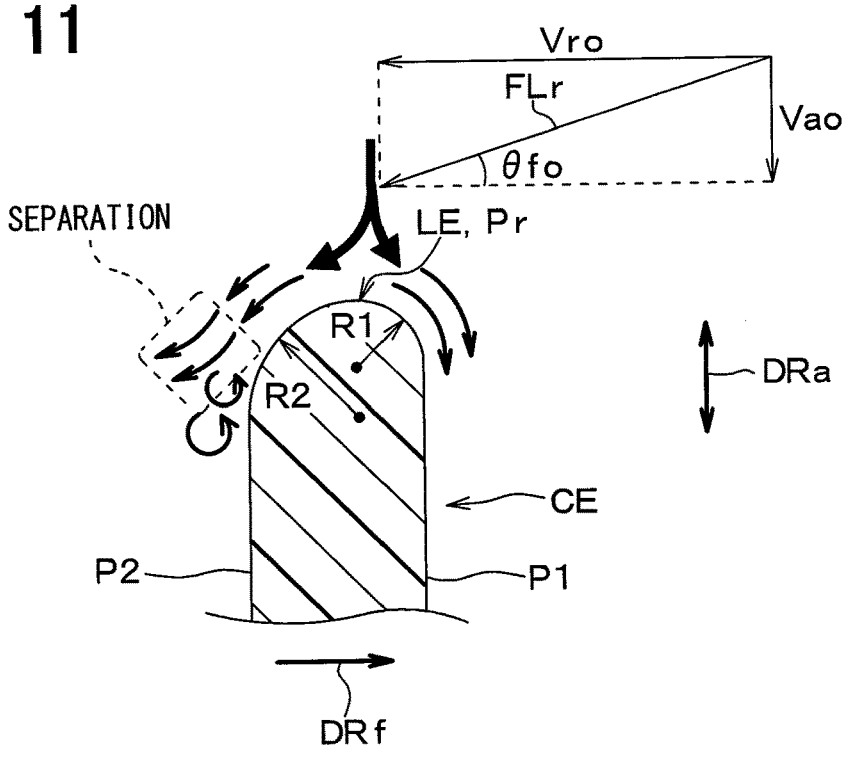
FIG. 11 is a view illustrating a flow of air flowing into a reverse flow portion of the intake side edge portion of the centrifugal blower as the comparative example of the first embodiment.

FIG. 10 shows a schematic cross-sectional shape of a main flow portion Pm of an intake side edge portion LE of the centrifugal blower CE as a comparative example of the centrifugal blower 10 in the present embodiment, and a flow manner of the air in the main flow portion Pm. FIG. 11 shows a schematic cross-sectional shape of a reverse flow portion Pr of the intake side edge portion LE of the centrifugal blower CE as a comparative example, and a flow manner of the air in the reverse flow portion Pr.

As shown in FIGS. 10 and 11, in the centrifugal blower CE of the comparative example, the cross-sectional shape of the main flow portion Pm and the cross-sectional shape of the reverse flow portion Pr are substantially equal to each other. Specifically, the main flow portion Pm and the reverse flow portion Pr have a curved surface shape (that is, a substantially arc shape) in which the shape of the end portion on the positive pressure surface P1 side has a predetermined radius of curvature R1. The main flow portion Pm and the reverse flow portion Pr have a curved surface shape (for example, a substantially arc shape) in which the shape of the end portion on the negative pressure surface P2 side has a radius of curvature R2 larger than a radius of curvature R1 on the positive pressure surface P1 side. The respective radii of curvature R1 and R2 are equal to each other in the main flow portion Pm and the reverse flow portion Pr. The centrifugal blower CE of the comparative example is configured in the same manner as the centrifugal blower 10 according to the present embodiment in other configurations.

In the centrifugal blower CE of the comparative example, a cross-sectional shape of the main flow portion Pm of the intake side edge portion LE is a curved surface shape curved into a curved surface shape. For that reason, as shown in FIG. 10, the air flowing into the negative pressure surface P2 side from the main flow portion Pm easily flows along the negative pressure surface P2.

On the other hand, in the centrifugal blower CE of the comparative example, the cross-sectional shape of the main flow portion Pm of the intake side edge portion LE and the cross-sectional shape of the reverse flow portion Pr are equal to each other, although the inflow angles θf of the air flowing into the main flow portion Pm and the reverse flow portion Pr are different from each other. For that reason, as shown in FIG. 11, the reverse flow flowing from the reverse flow portion Pr to the negative pressure surface P2 side tends to peel off from the negative pressure surface P2.

Figure 12:
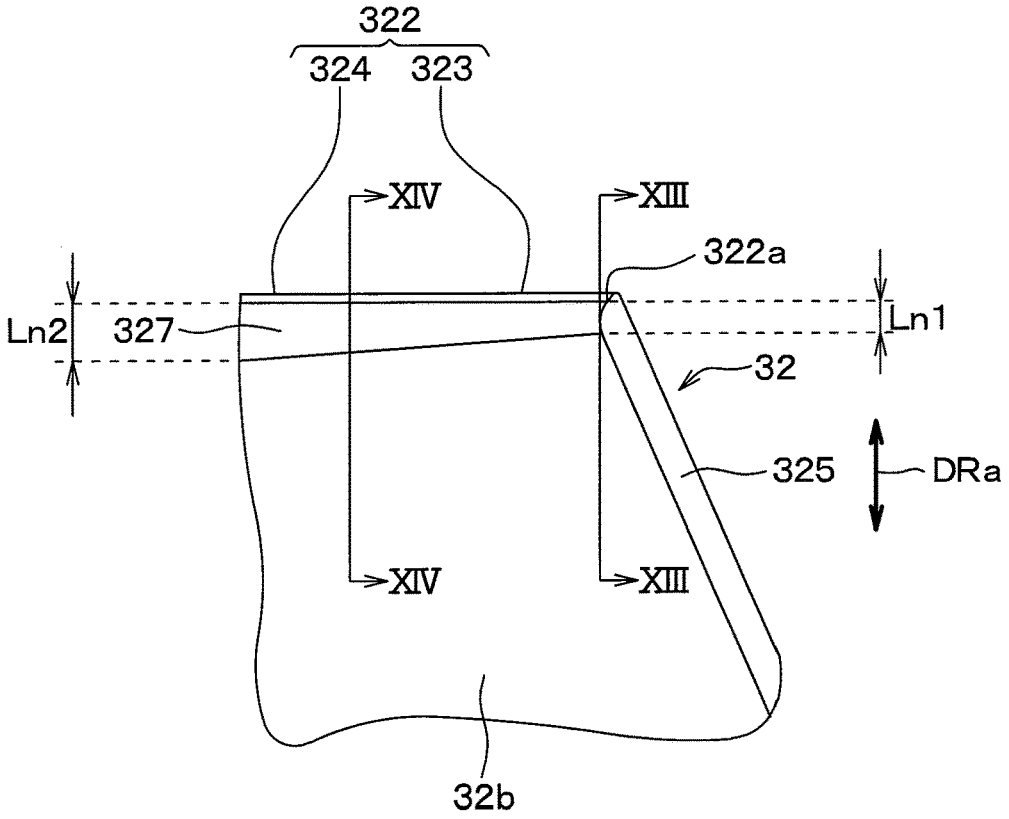
FIG. 12 is a schematic enlarged view illustrating the intake side edge portion of the centrifugal blower according to the first embodiment.
Figure 13:
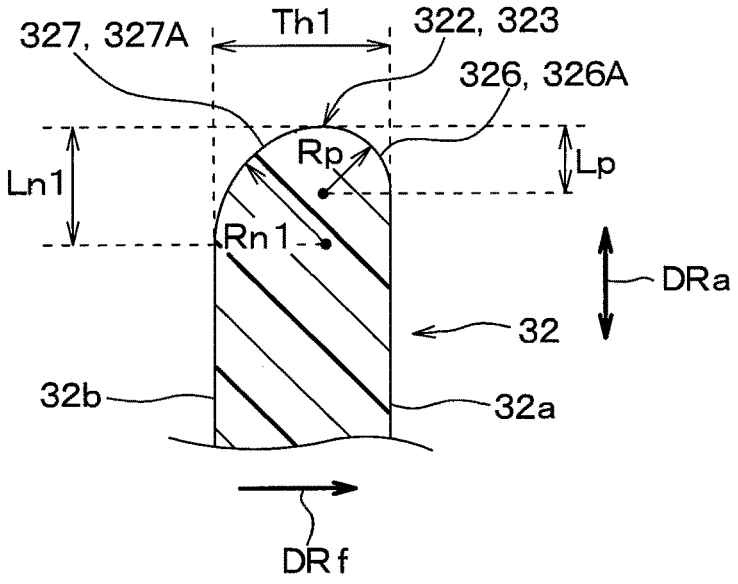
FIG. 13 is a cross-sectional view taken along a line XIII-XIII of FIG. 12.
Figure 14:
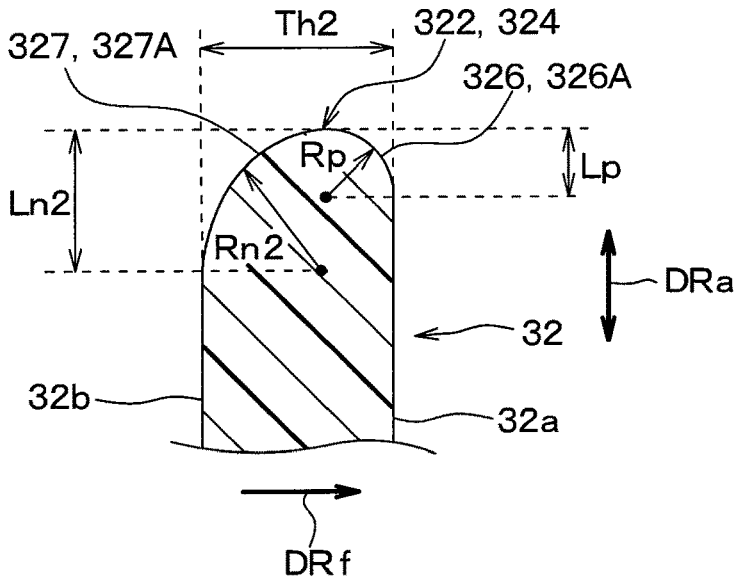
FIG. 14 is a cross-sectional view taken along a line XIV-XIV of FIG. 12.

In consideration of those factors, in the present embodiment, as shown in FIGS. 12 to 14, a positive pressure side inclined portion 326 and a negative pressure side inclined portion 327 inclined with respect to the axial direction DRa are provided on both the positive pressure surface 32*a* side and the negative pressure surface 32*b* side of the intake side edge portion 322 of each blade 32.

The positive pressure side inclined portion 326 is inclined with respect to the axial direction DRa so that the blade thickness of each blade 32 becomes smaller as the blade 32 comes closer to the tip portion of the intake side edge portion 322. In the positive pressure side inclined portion 326 according to the present embodiment, a length Lp of the inclined section in the axial direction DRa is equal to each other in the main flow portion 323 and the reverse flow portion 324. In other words, in the positive pressure side inclined portion 326 according to the present embodiment, the length Lp of the inclined section in the axial direction DRa is kept substantially constant from the inside to the outside of the radial direction DRr.

More specifically, as shown in FIGS. 13 and 14, the positive pressure side inclined portion 326 has a curved inclined surface 326A with a curved shape (for example, substantially arcuate shape) having a predetermined radius of curvature Rp. The radius of curvature Rp of the curved inclined surface 326A of the positive pressure side inclined portion 326 is equal to each other in the main flow portion 323 and the reverse flow portion 324. In the positive pressure side inclined portion 326 according to the present embodiment, the radius of curvature Rp of the curved inclined surface 326A is kept substantially constant from the inside to the outside in the radial direction DRr.

The negative pressure side inclined portion 327 is inclined with respect to the axial direction DRa so that the blade thickness of each blade 32 becomes smaller as the blade comes closer to the tip portion of the intake side edge portion 322. In the negative pressure side inclined portion 327, the length Ln of the inclined section in the axial direction DRa is different from each other in the main flow portion 323 and the reverse flow portion 324. In other words, in the negative pressure side inclined portion 327, a length Ln2 of the inclined section in the reverse flow portion 324 is larger than the length Ln1 of the inclined section on the radially innermost portion 322*a* side of the intake side edge portion 322 (that is, Ln2>Ln1).

In this example, if a length Ln of the inclined section of the negative pressure side inclined portion 327 is gradually increased from the inner side to the outer side in the radial direction DRr, there is a fear that new turbulence is generated in the air flow in the negative pressure side inclined portion 327. For that reason, the negative pressure side inclined portion 327 according to the present embodiment continuously increases the length Ln of the inclined section from the inner side to the outer side in the radial direction DRr.

More specifically, the negative pressure side inclined portion 327 is a curved inclined surface 327A with a curved surface (for example, substantially arcuate shape) having a radius of curvature Rn larger than the radius of curvature Rp of the positive pressure side inclined portion 326. The curved inclined surface 327A of the negative pressure side inclined portion 327 has a larger radius of curvature Rn2 in the reverse flow portion 324 than the radius of curvature Rn1 on the radially innermost portion 322*a* side of the intake side edge portion 322 (that is, Rn2>Rn1). In the negative pressure side inclined portion 327 according to the present embodiment, the radius of curvature Rn of the curved inclined surface 327A increases from the inner side to the outer side in the radial direction DRr.

Here, if the blade 32 is thin, it is difficult to secure the length Ln of the inclined section in the intake side edge portion 322. For that reason, a blade thickness Th2 of the reverse flow portion 324 is larger than the blade thickness Th1 of the intake side edge portion 322 on the radially innermost portion 322*a* side (that is, Th2>Th1) in the blade 32 according to the present embodiment.

Figure 15:
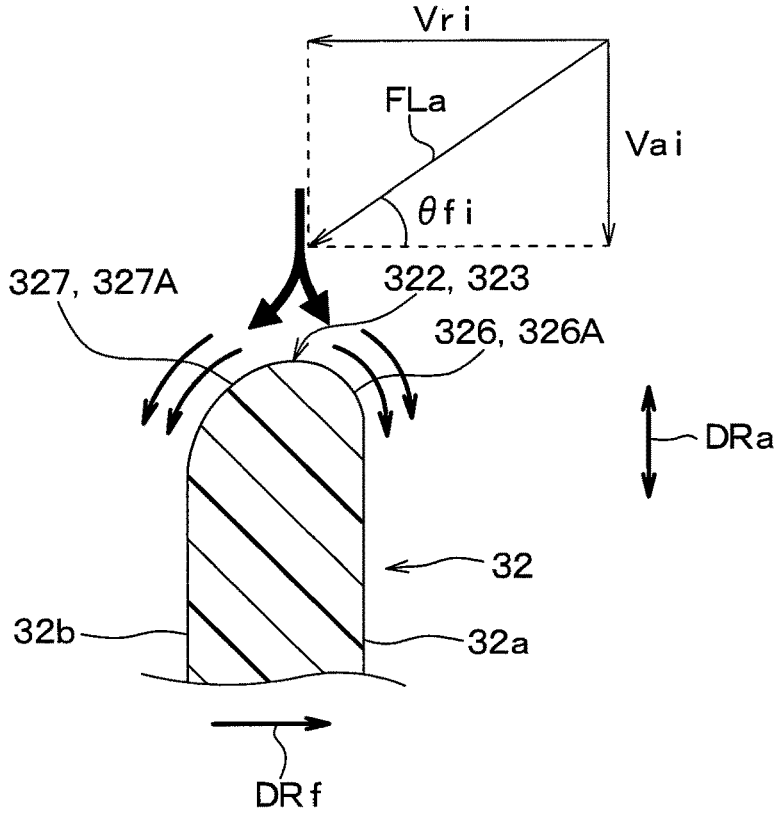
FIG. 15 is a view illustrating a flow of air flowing into a main flow portion of the intake side edge portion in the centrifugal blower according to the first embodiment.

As described above, in the centrifugal blower 10 according to the present embodiment, the negative pressure side inclined portion 327 is formed in the main flow portion 323 of the intake side edge portion 322. The negative pressure side inclined portion 327 has a curved surface shape in which the cross-sectional shape on the main flow portion 323 side is curved into a curved shape. For that reason, as shown in FIG. 15, the air flowing from the main flow portion 323 to the negative pressure surface 32*b* side easily flows along the negative pressure surface 32*b* through the negative pressure side inclined portion 327.

On the other hand, in the negative pressure side inclined portion 327, the length Ln2 of the inclined section on the side of the reverse flow portion 324 is larger than the length Ln1 of the inclined section on the side of the main flow portion 323. The negative pressure side inclined portion 327 has a curved surface shape in which a cross-sectional shape on the side of the reverse flow portion 324 is curved. In the negative pressure side inclined portion 327, the radius of curvature Rn2 on the side of the reverse flow portion 324 is larger than the radius of curvature Rn1 on the side of the main flow portion 323.

Figure 16:
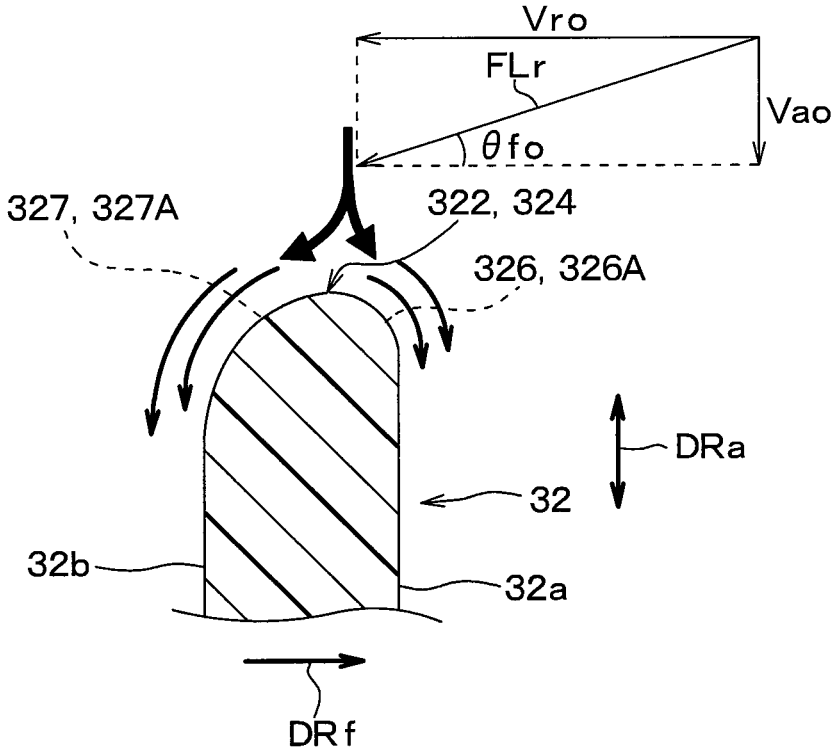
FIG. 16 is a view illustrating a flow of air flowing into the reverse flow portion of the intake side edge portion in the centrifugal blower according to the first embodiment.

For that reason, as shown in FIG. 16, the air flowing into the negative pressure surface 32*b* side from the reverse flow portion 324 easily flows along the negative pressure surface 32*b* through the negative pressure side inclined portion 327. In other words, the air flowing into the negative pressure surface 32*b* side from the reverse flow portion 324 is guided to the negative pressure surface 32*b* along the negative pressure side inclined portion 327 without being peeled off by the negative pressure side inclined portion 327.

In the centrifugal blower 10 according to the present embodiment described above, since the intake side edge portion 322 extending along the radial direction DRr is provided with respect to the blade 32, an effective area for blowing the air can be sufficiently ensured.

In addition, in the centrifugal blower 10, since the length Ln of the inclined section of the negative pressure side inclined portion 327 formed in the intake side edge portion 322 is larger in the reverse flow portion 324 than in the main flow portion 323, a sudden change in the direction of the air flow in the vicinity of the negative pressure side inclined portion 327 can be reduced.

As a result, the reverse flow flowing into the centrifugal fan 30 through the gap flow channel 333 between the intake side case portion 22 and the shroud 33 easily flows along the negative pressure side inclined portion 327 by the flow regulation action by the Coanda effect. As a result, the separation of the air in the negative pressure surface 32*b* is reduced. As a result, the turbulence of the air flow in the vicinity of the intake side edge portion 322 of the blade 32 is reduced, so that the generation of the noise of the centrifugal blower 10 can be reduced.

Figure 17:
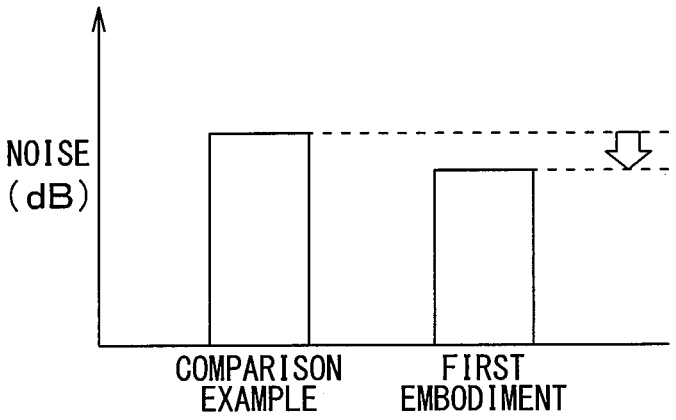
FIG. 17 is a diagram showing a measurement result of noise when the centrifugal blower of the first embodiment and the centrifugal blower of the comparative example are operated under the same measurement conditions.

In this example, FIG. 17 is a diagram showing a measurement result of the noise when the centrifugal blower 10 according to the present embodiment and the centrifugal blower CE of the comparative example are operated under the same measurement conditions. Referring to FIG. 17, it can be seen that the centrifugal blower 10 according to the present embodiment has a greater effect of reducing the noise as compared with the centrifugal blower CE of the comparative example.

In the centrifugal blower 10 according to the present embodiment, the length Ln of the inclined section of the negative pressure side inclined portion 327 continuously increases from the inner side toward the outer side in the radial direction DRr. With such a configuration, a new turbulence can be inhibited from occurring in the air flow flowing through the negative pressure side inclined portion 327.

Further, in the centrifugal blower 10 according to the present embodiment, the negative pressure side inclined portion 327 is configured by the curved inclined surface 327A formed in a curved surface shape, and the radius of curvature Rn2 of the reverse flow portion 324 is larger than the radius of curvature Rn1 of the radially innermost portion 322*a* of the intake side edge portion 322.

This makes it possible to smoothly flow the reverse flow flowing into the centrifugal fan 30 through the gap flow channel 333 between the intake side case portion 22 and the shroud 33 along the negative pressure side inclined portion 327.

Furthermore, in the centrifugal blower 10 according to the present embodiment, the blade thickness Th2 of the reverse flow portion 324 is larger than the blade thickness Th1 of the radially innermost portion 322*a* of the intake side edge portion 322, (that is, Th2>Th1).

As described above, if the blade thickness of the reverse flow portion 324 close to the shroud 33 in the intake side edge portion 322 is increased, the inclined section of the negative pressure side inclined portion 327 on the side of the reverse flow portion 324 can be sufficiently increased as compared with the inclined section of the negative pressure side inclined portion 327 on the side of the radially innermost portion 322*a*. In other words, a sufficient difference can be made between the inclined section of the negative pressure side inclined portion 327 on the side of the shroud 33 and the side of the radially innermost portion 322*a* in the intake side edge portion 322.

Modification of First Embodiment

In the first embodiment described above, an example has been described in which the length Lp of the inclined section of the positive pressure side inclined portion 326 formed on the intake side edge portion 322 is kept substantially constant from the inside to the outside in the radial direction DRr, but the present disclosure is not limited to the above example.

Figure 18:
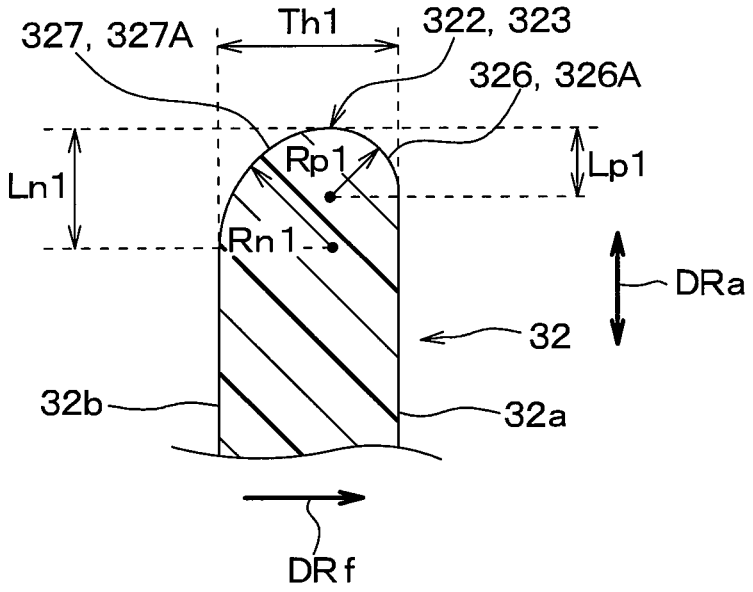
FIG. 18 is a schematic cross-sectional view illustrating the vicinity of a radially innermost portion of an intake side edge portion in the centrifugal blower as a modification of the first embodiment.
Figure 19:
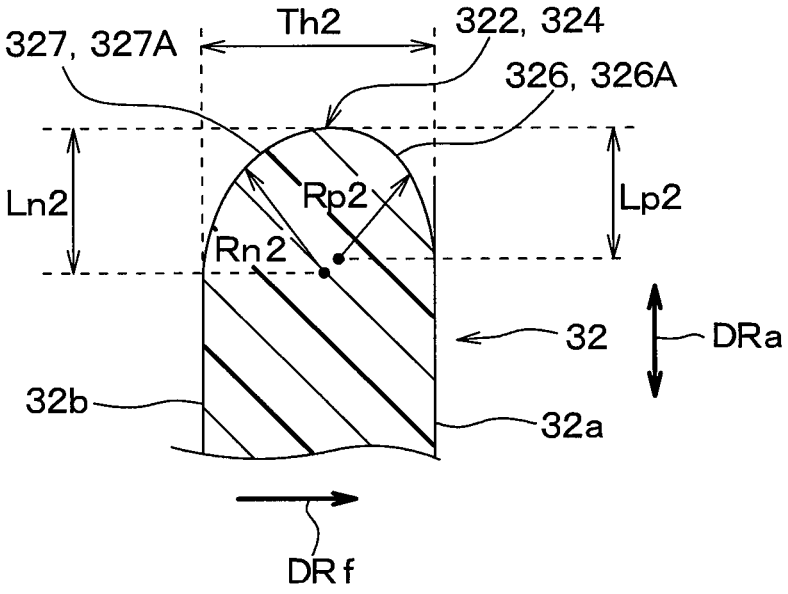
FIG. 19 is a schematic cross-sectional view illustrating the vicinity of a reverse flow portion of the intake side edge portion in the centrifugal blower as a modification of the first embodiment.

For example, as shown in FIGS. 18 and 19, a length Lp2 of the inclined section in the reverse flow portion 324 of the positive pressure side inclined portion 326 may be larger than a length Lp1 of the inclined section in the radially innermost portion 322*a* of the intake side edge portion 322 (that is, Lp2>Lp1).

The curved inclined surface 326A of the positive pressure side inclined portion 326 according to the present modification has a larger radius of curvature Rp2 in the reverse flow portion 324 than the radius of curvature Rp1 in the radially innermost portion 322*a* of the intake side edge portion 322 (i.e., Rp2>Rp1). In the positive pressure side inclined portion 326 of the present modification, the radius of curvature Rp of the curved inclined surface 326A increases from the inner side to the outer side in the radial direction DRr.

The other the configuration is the same as that of the first embodiment. The centrifugal blower 10 of the present modification can obtain the following effects in addition to the effects described in the first embodiment. In other words, in the centrifugal blower 10 of the present modification, the length Lp2 of the inclined section of the reverse flow portion 324 of the positive pressure side inclined portion 326 is larger than that of the radially innermost portion 322*a*. According to the above configuration, the reverse flow flowing into the centrifugal fan 30 through the gap flow channel 333 between the intake side case portion 22 and the shroud 33 easily flows along the positive pressure side inclined portion 326 by the flow regulation by the Coanda effect. As a result, the turbulence of the air flow in the vicinity of the intake side edge portion 322 is reduced, so that the generation of the noise in the centrifugal blower 10 can be reduced.

Second Embodiment

Next, a second embodiment will be described with reference to FIGS. 20 to 24. A centrifugal blower 10 according to the present embodiment is different from the first embodiment in a cross-sectional shape of an intake side edge portion 322.

Figure 20:
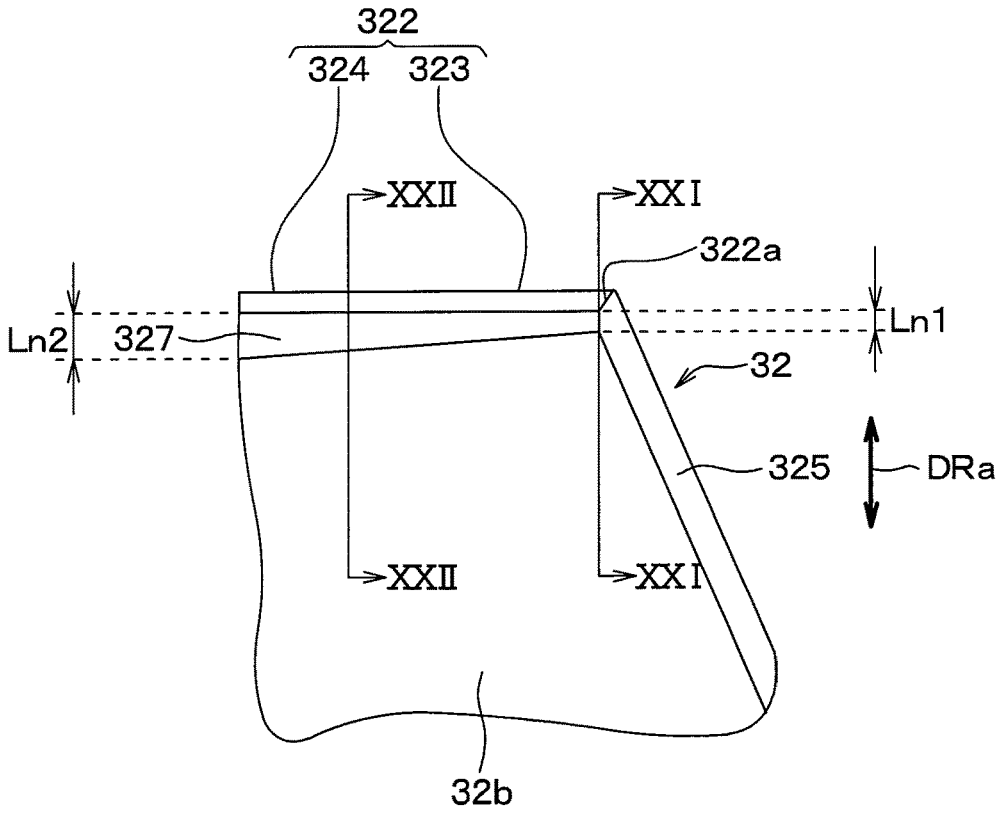
FIG. 20 is a schematic enlarged view illustrating an intake side edge portion of a centrifugal blower according to a second embodiment.
Figure 21:
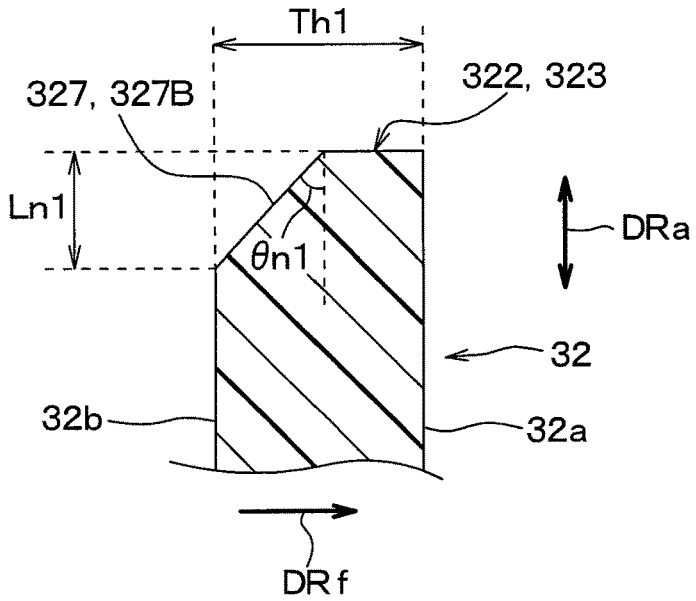
FIG. 21 is a cross-sectional view taken along a line XXI-XXI of FIG. 20.
Figure 22:
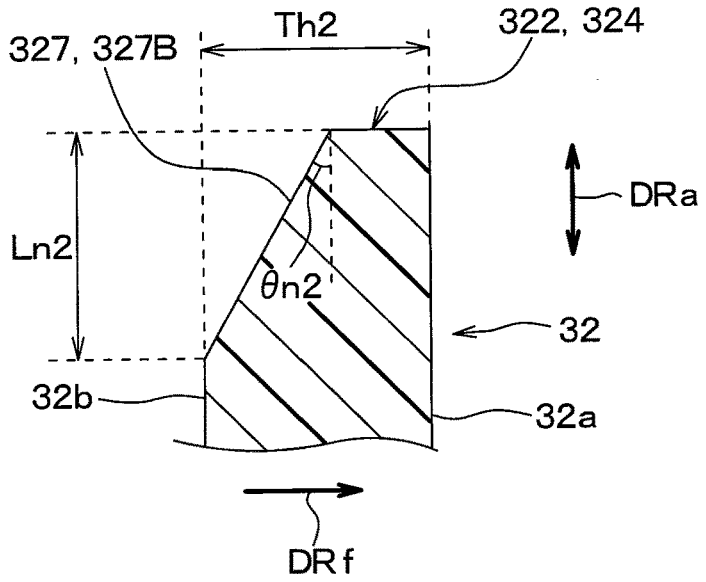
FIG. 22 is a cross-sectional view taken along a line XXII-XXII of FIG. 20.

As shown in FIGS. 20 to 22, the intake side edge portion 322 according to the present embodiment is provided with a negative pressure side inclined portion 327, but is not provided with the positive pressure side inclined portion 326 described in the first embodiment.

As shown in FIGS. 21 and 22, in the negative pressure side inclined portion 327 according to the present embodiment, a length Ln2 of an inclined section in a reverse flow portion 324 is larger than a length Ln1 of an inclined section on an radially innermost portion 322*a* side of the intake side edge portion 322 (that is, Ln2>Ln1). In the negative pressure side inclined portion 327 according to the present embodiment, the length Ln of the inclined section continuously increases from the inner side to the outer side in the radial direction DRr.

More specifically, the negative pressure side inclined portion 327 is formed of a linear inclined surface 327B that is linearly inclined with respect to an axial direction DRa. The linear inclined surface 327B of the negative pressure side inclined portion 327 has an inclination angle θn2 in the reverse flow portion 324 smaller than an inclination angle θn1 on the radially innermost portion 322*a* side of the intake side edge portion 322 (that is, θn2<θn1). In the negative pressure side inclined portion 327 according to the present embodiment, an inclination angle zθn of the linear inclined surface 327B decreases from the inner side to the outer side in the radial direction DRr. The inclination angle θn is an angle formed by the axial direction DRa.

In blades 32 according to the present embodiment, a blade thickness Th2 of the reverse flow portion 324 is larger than a blade thickness Th1 of the radially innermost portion 322*a* of the intake side edge portion 322 (that is, Th2>Th1).

Figure 23:
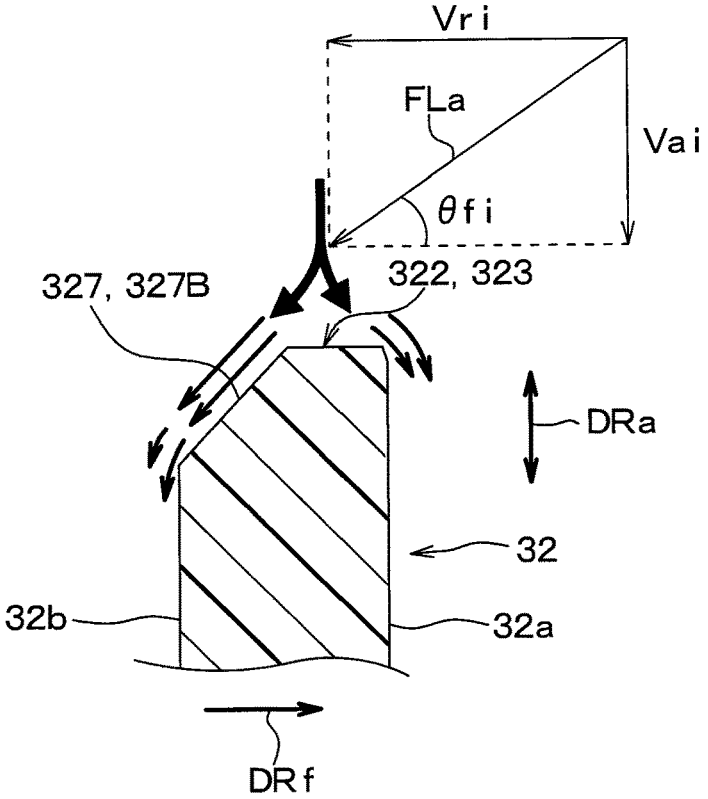
FIG. 23 is a view illustrating a flow of air flowing into a main flow portion of the intake side edge portion in the centrifugal blower according to the second embodiment.

As described above, in the centrifugal blower 10 according to the present embodiment, the negative pressure side inclined portion 327 is formed in the main flow portion 323 of the intake side edge portion 322. A cross-sectional shape of the negative pressure side inclined portion 327 on the main flow portion 323 side is linearly inclined. For that reason, as shown in FIG. 23, the air flowing from the main flow portion 323 to a negative pressure surface 32*b* side easily flows along the negative pressure surface 32*b* through the negative pressure side inclined portion 327.

On the other hand, in the negative pressure side inclined portion 327, the length Ln2 of the inclined section on the side of the reverse flow portion 324 is larger than the length Ln1 of the inclined section on the side of the main flow portion 323. In the negative pressure side inclined portion 327, the cross-sectional shape on the side of the reverse flow portion 324 is linearly inclined. In the negative pressure side inclined portion 327, the inclination angle θn2 on the side of the reverse flow portion 324 is smaller than the inclination angle θn1 on the side of the main flow portion 323.

Figure 24:
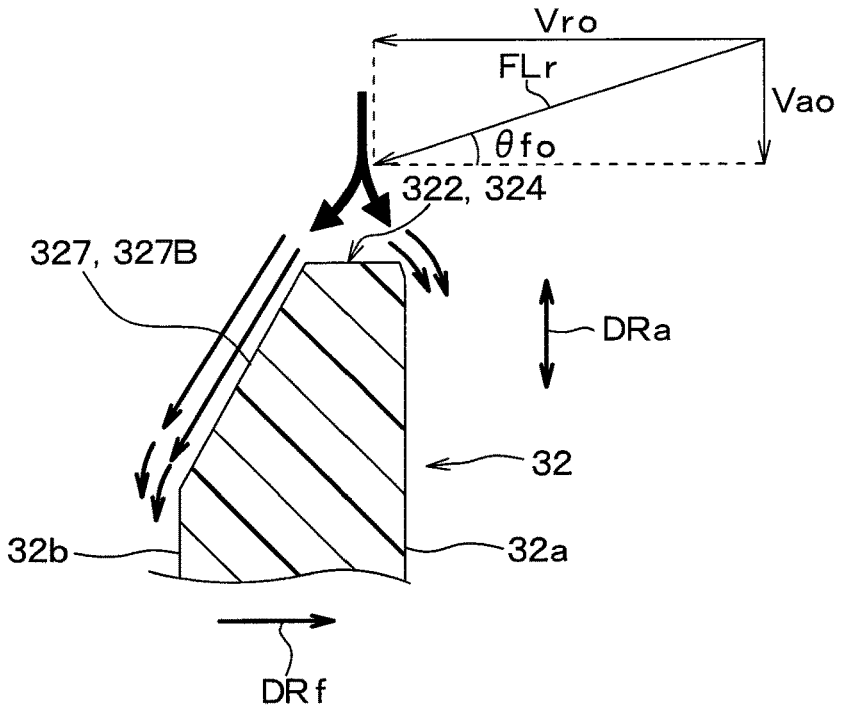
FIG. 24 is a view illustrating a flow of air flowing into a reverse flow portion of the intake side edge portion in the centrifugal blower according to the second embodiment.

For that reason, as shown in FIG. 24, the air flowing into the negative pressure surface 32*b* side from the reverse flow portion 324 easily flows along the negative pressure surface 32*b* through the negative pressure side inclined portion 327. In other words, the air flowing into the negative pressure surface 32*b* side from the reverse flow portion 324 is guided to the negative pressure surface 32*b* along the negative pressure side inclined portion 327 without being peeled off by the negative pressure side inclined portion 327.

The other configuration is the same as that of the first embodiment. The centrifugal blower 10 according to the present embodiment can obtain the same operation and effects as those of the first embodiment, which are obtained from the same configuration as that of the first embodiment.

In particular, the centrifugal blower 10 according to the present embodiment is configured by the linear inclined surface 327B in which the negative pressure side inclined portion 327 is formed linearly, and the inclination angle θn2 of the reverse flow portion 324 is smaller than the inclination angle θn1 of the intake side edge portion 322 on the radially innermost portion 322*a* side. This also makes it possible to flow the reverse flow flowing into the centrifugal fan 30 through the gap flow channel 333 between the intake side case portion 22 and the shroud 33 along the negative pressure side inclined portion 327 by the flow regulation by the Coanda effect.

First Modification of Second Embodiment

In the second embodiment described above, an example has been described in which the negative pressure side inclined portion 327 is configured by the linear inclined surface 327B inclined linearly with respect to the axial direction DRa, but the present disclosure is not limited to the above example.

Figure 25:
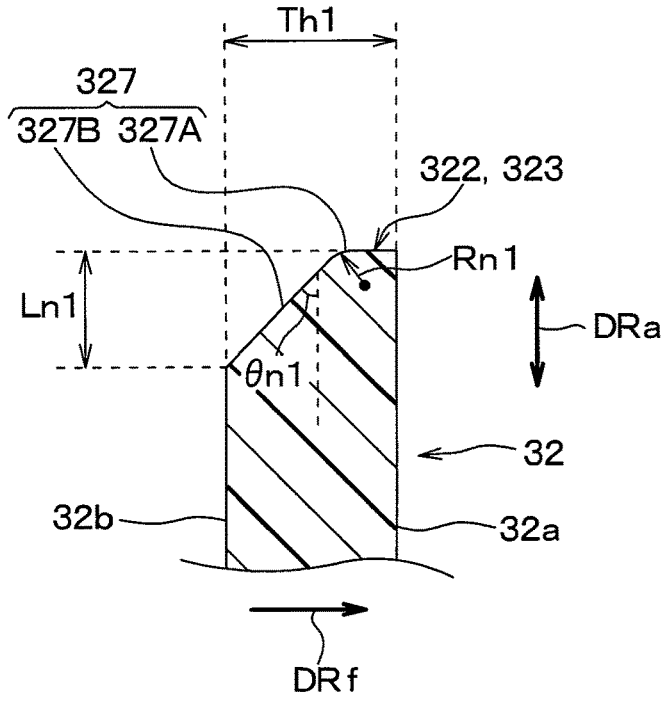
FIG. 25 is a schematic cross-sectional view illustrating the vicinity of a main flow portion of an intake side edge portion in a centrifugal blower as a first modification of the second embodiment.
Figure 26:
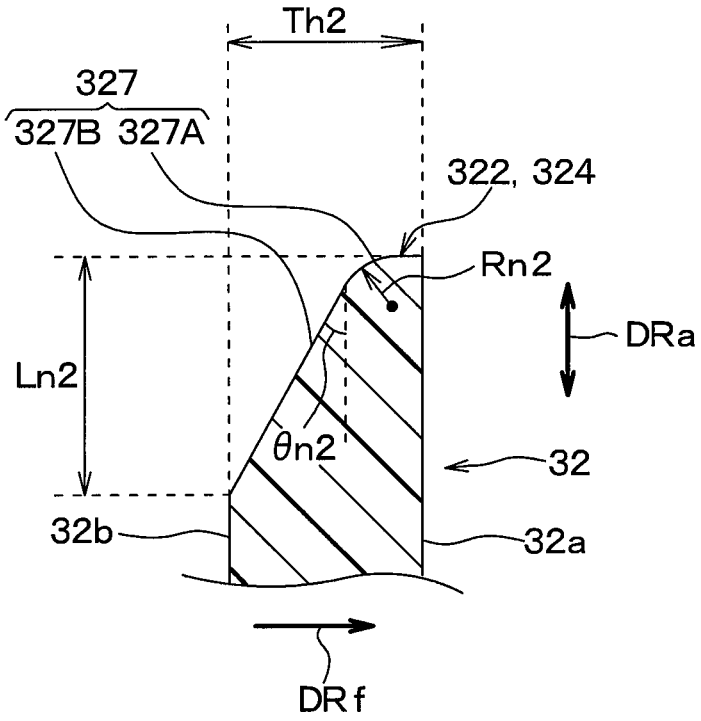
FIG. 26 is a schematic cross-sectional view illustrating the vicinity of a reverse flow portion of the intake side edge portion in the centrifugal blower as the first modification of the second embodiment.

As shown in FIGS. 25 and 26, the negative pressure side inclined portion 327 is configured by a curved inclined surface 327A having a curved surface shape (that is, a substantially arcuate shape) and a linear inclined surface 327B inclined linearly with respect to the axial direction DRa.

Specifically, the negative pressure side inclined portion 327 is configured by the curved inclined surface 327A on a tip portion side of the intake side edge portion 322, and is configured by the linear inclined surface 327B on a portion separated from the tip portion of the intake side leading edge portion 322 by a predetermined distance.

The curved inclined surface 327A of the negative pressure side inclined portion 327 has a larger radius of curvature Rn2 in the reverse flow portion 324 than the radius of curvature Rn1 on the radially innermost portion 322*a* side of the intake side edge portion 322 (that is, Rn2>Rn1).

The linear inclined surface 327B of the negative pressure side inclined portion 327 has an inclination angle θn2 in the reverse flow portion 324 smaller than an inclination angle θn1 on the radially innermost portion 322*a* side of the intake side edge portion 322 (that is, θn2<θn1).

The other the configuration is the same as that of the second embodiment. According to the centrifugal blower 10 of the present modification, the operation and effects described in the first and second embodiments can be obtained. In other words, in the centrifugal blower 10 of the present modification, since the turbulence of the air flow in the vicinity of the intake side edge portion 322 is reduced, the generation of the noise in the centrifugal blower 10 can be reduced.

Second Modification of Second Embodiment

In the second embodiment described above, an example in which the positive pressure side inclined portion 326 is not provided on the side of the positive pressure surface 32*a* of the intake side edge portion 322 has been described, but the present invention is not limited to the above example, and the positive pressure side inclined portion 326 may be formed.

In this example, the positive pressure side inclined portion 326 can be configured by, for example, a linear inclined surface linearly inclined with respect to the axial direction DRa, similarly to the linear inclined surface 327B described in the negative pressure side inclined portion 327 of the second embodiment. The positive pressure side inclined portion 326 may be configured by the curved inclined surface 326A described in the first embodiment.

OTHER EMBODIMENTS

Although the representative embodiments of the present disclosure have been described above, the present disclosure is not limited to the embodiments described above, and various modifications can be made, for example, as follows.

In the first embodiment, the positive pressure side inclined portion 326 and the negative pressure side inclined portion 327 are provided for the intake side edge portion 322, but the present disclosure is not limited to the above example. The centrifugal blower 10 according to the first embodiment may have a configuration in which, for example, the intake side edge portion 322 is provided with the negative pressure side inclined portion 327 and is not provided with the positive pressure side inclined portion 326.

In the embodiments described above, the blade thickness Th2 of the reverse flow portion 324 in each blade 32 is larger than the blade thickness Th1 of the radially innermost portion 322*a* of the intake side edge portion 322, but the present disclosure is not limited to the above example. For example, the blade thickness Th2 of the reverse flow portion 324 in the respective blades 32 may be equal to the blade thickness Th1 of the radially innermost portion 322*a* of the intake side edge portion 322.

In each of the embodiments described above, the rotor body 411 is fixed to the rotation shaft housing 110 and the air flow guide surface 411*a* is formed on the rotor body 411, but the present disclosure is not limited to the above example. The centrifugal blower 10 may have, for example, a configuration in which a fan boss portion for fixing the fan body 31 to the rotation shaft housing 110 is added to the centrifugal fan 30, and an air flow guide surface for guiding the air flow drawn from the intake port 221 is formed on the surface of the fan boss portion.

In each of the embodiments, the centrifugal fan 30 is formed of the fan body 31 and the fan plate 35, but the present disclosure is not limited to the above example. The centrifugal fan 30 has only to be able to blow out the air drawn from the axial direction DRa to the outside of the radial direction DRr. The centrifugal fan 30 may be configured so as to include, for example, the fan body 31, and omit the fan plate 35. The centrifugal fan 30 may have a configuration in which, for example, the fan body 31 is formed by coupling components molded separately.

In each of the embodiments described above, the centrifugal blower 10 of the present disclosure is applied to the seat air conditioner for a vehicle, but the application target of the centrifugal blower 10 is not limited to the seat air conditioner. The centrifugal blower 10 according to the present disclosure is applicable to various devices other than the seat air conditioner.

In the respective embodiments above, it goes without saying that elements forming the embodiments are not necessarily essential unless specified as being essential or deemed as being apparently essential in principle.

In a case where a reference is made to the components of the respective embodiments as to numerical values, such as the number, values, amounts, and ranges, the components are not limited to the numerical values unless specified as being essential or deemed as being apparently essential in principle.

In a case where a reference is made to the components of the respective embodiments above as to shapes and positional relations, the components are not limited to the shapes and the positional relations unless explicitly specified or limited to particular shapes and positional relations in principle.

According to a first aspect represented by a part or all of the embodiments, in a centrifugal blower, the blade of the centrifugal fan has an intake side edge portion extending from the intake side plate inward in the radial direction. The intake side edge portion has a negative pressure side inclined portion inclined on the negative pressure surface side with respect to the axial direction. The negative pressure side inclined portion has an inclination length in the axial direction, and the inclination length is larger in a proximal portion of the intake side edge portion close to the intake side plate than in a radially innermost portion of the intake side edge portion located at an innermost side in the radial direction.

According to a second aspect, in the centrifugal blower, the inclination length of the negative pressure side inclined portion continuously increases from an inner side to an outer side in the radial direction. A new turbulence is restricted from being generated in the air flow in the negative pressure side inclined portion, when the inclination length of the negative pressure side inclined portion is gradually increased from the inner side to the outer side in the radial direction.

According to a third aspect, in the centrifugal blower, the negative pressure side inclined portion includes a curved inclined surface formed in a curved shape. A radius of curvature of the curved inclined surface in the proximal portion is larger than a radius of curvature of the curved inclined surface in the radially innermost portion. Therefore, the reverse flow flowing into the centrifugal fan through the gap between the intake side case portion and the intake side plate can be easily made to flow along the negative pressure side inclined portion.

According to a fourth aspect, in the centrifugal blower, the negative pressure side inclined portion includes a linear inclined surface inclined linearly with respect to the axial direction. An inclined angle of the linear inclined surface at the proximal portion is smaller than an inclined angle of the linear inclined surface at the radially innermost portion. Therefore, the reverse flow flowing into the centrifugal fan through the gap between the intake side case portion and the intake side plate can be easily made to flow along the negative pressure side inclined portion.

According to a fifth aspect, in the centrifugal blower, the negative pressure side inclined portion includes a curved inclined surface formed in a curved shape and a linear inclined surface inclined linearly with respect to the axial direction. Therefore, the reverse flow flowing into the centrifugal fan through the gap between the intake side case portion and the intake side plate can be easily made to flow along the negative pressure side inclined portion.

According to a sixth aspect, in the centrifugal blower, the intake side edge portion has a positive pressure side inclined portion inclined with respect to the axial direction on the positive pressure surface side. The positive pressure side inclined portion has an inclination length that is larger in the proximal portion larger than in the radially innermost portion.

As a result, the reverse flow flowing into the centrifugal fan through the gap between the intake side case portion and the intake side plate easily flows along the positive pressure side inclined portion by making the inclination length of the pressure side inclined portion to be larger in the proximal portion adjacent to the intake side plate than in the radially innermost portion. As a result, the turbulence of the air flow in the vicinity of the intake side edge portion is reduced, so that the generation of the noise of the centrifugal blower can be reduced.

According to a seventh aspect, in the centrifugal blower, a blade thickness of the proximal portion is larger than a blade thickness of the radially innermost portion. When the blade thickness of the proximal portion close to the intake side plate in the intake side edge portion is increased, the inclined section of the negative pressure side inclined portion on the side of the intake side plate can be sufficiently increased as compared with the inclined section of the negative pressure side inclined portion on the side of the radially innermost portion. In other words, a sufficient difference can be made in the inclined section of the negative pressure side inclined portion between the side of the intake side plate and the side of the radially innermost portion in the intake side edge portion.

According to an eighth aspect, in the centrifugal blower, the intake side case portion has an intake port defining portion defining the intake port. The intake port defining portion overlaps with the intake side edge portion in the axial direction. The proximal portion is an overlapping portion of the intake side edge portion overlapping with the intake side case portion in the axial direction. As a result, the turbulence of the air flow in the vicinity of the intake side edge portion is reduced, since the inclination length can be sufficiently secured in the overlapping portion of the intake side edge portion overlapping with the intake side case portion.

What is claimed is:

1. A centrifugal blower that blows air, comprising:

a centrifugal fan that rotates with a rotation shaft to draw in air in an axial direction of the rotation shaft and to blow out the air outward in a radial direction of the rotation shaft; and a case that houses the centrifugal fan, the case having an intake port to draw in air into the centrifugal fan, wherein the centrifugal fan includes a plurality of blades arranged around an axis center of the rotation shaft, and an intake side plate shaped in a ring that connects ends of the plurality of blades adjacent to the intake port to each other, the case has an intake side case portion facing the intake side plate with a predetermined gap, the intake side case portion having the intake port, each of the plurality of blades has a positive pressure surface extending along the axial direction, a negative pressure surface opposite to the positive pressure surface, and an intake side edge portion extending from the intake side plate inward in the radial direction, the intake side edge portion has a negative pressure side inclined portion inclined to the negative pressure surface with respect to the axial direction, and the negative pressure side inclined portion has an inclination length in the axial direction, and the inclination length is larger in a proximal portion of the intake side edge portion adjacent to the intake side plate than in a radially innermost portion of the intake side edge portion located at an innermost side in the radial direction.

2. The centrifugal blower according to claim 1, wherein the inclination length of the negative pressure side inclined portion continuously increases from an inner side to an outer side in the radial direction.

3. The centrifugal blower according to claim 1, wherein the negative pressure side inclined portion includes a curved inclined surface formed in a curved shape, and a radius of curvature of the curved inclined surface in the proximal portion is larger than a radius of curvature of the curved inclined surface in the radially innermost portion.

4. The centrifugal blower according to claim 1, wherein the negative pressure side inclined portion includes a linear inclined surface inclined linearly with respect to the axial direction, and an inclined angle of the linear inclined surface at the proximal portion is smaller than an inclined angle of the linear inclined surface at the radially innermost portion.

5. The centrifugal blower according to claim 1, wherein the negative pressure side inclined portion includes a curved inclined surface formed in a curved shape and a linear inclined surface inclined linearly with respect to the axial direction.

6. The centrifugal blower according to claim 1, wherein the intake side edge portion has a positive pressure side inclined portion inclined with respect to the axial direction on the positive pressure surface side, and the positive pressure side inclined portion has an inclination length that is larger in the proximal portion than in the radially innermost portion.

7. The centrifugal blower according to claim 1, wherein a blade thickness of the proximal portion is larger than a blade thickness of the radially innermost portion.

8. The centrifugal blower according to claim 1, wherein the intake side case portion has an intake port defining portion defining the intake port, the intake port defining portion overlaps with the intake side edge portion in the axial direction, and the proximal portion is an overlapping portion of the intake side edge portion overlapping with the intake side case portion in the axial direction.

* * * * *